US008583491B2

(12) United States Patent
Feldman et al.

(10) Patent No.: US 8,583,491 B2
(45) Date of Patent: Nov. 12, 2013

(54) MULTIMEDIA DISPLAY, MULTIMEDIA SYSTEM INCLUDING THE DISPLAY AND ASSOCIATED METHODS

(75) Inventors: Michael R. Feldman, Huntersville, NC (US); James E. Morris, Lake Wylie, SC (US); Jennifer L. Wooten, Winston-Salem, NC (US)

(73) Assignee: T1visions, Inc., Charlotte, NC (US)

( * ) Notice: Subject to any disclaimer, the term of this patent is extended or adjusted under 35 U.S.C. 154(b) by 889 days.

(21) Appl. No.: 12/222,670

(22) Filed: Aug. 13, 2008

(65) Prior Publication Data

US 2009/0076920 A1 Mar. 19, 2009

Related U.S. Application Data

(60) Provisional application No. 60/994,458, filed on Sep. 19, 2007.

(51) Int. Cl.
*G06Q 30/00* (2012.01)
*A63F 9/24* (2006.01)
*H01Q 21/00* (2006.01)

(52) U.S. Cl.
USPC ..... 705/15; 463/25; 343/893

(58) Field of Classification Search
None
See application file for complete search history.

(56) References Cited

U.S. PATENT DOCUMENTS 5,412,564 A 5/1995 Ecer
5,589,856 A * 12/1996 Stein et al. ..... 345/173
5,825,352 A 10/1998 Bisset et al.
5,825,353 A 10/1998 Will
5,896,126 A * 4/1999 Shieh ..... 345/173
5,943,043 A * 8/1999 Furuhata et al. ..... 345/173
6,301,564 B1 10/2001 Halverson
6,424,248 B1 7/2002 Toms et al.
6,498,590 B1 * 12/2002 Dietz et al. ..... 343/893
6,529,786 B1 3/2003 Sim
6,844,893 B1 * 1/2005 Miller et al. ..... 348/14.1
6,856,259 B1 * 2/2005 Sharp ..... 341/5
6,876,973 B1 4/2005 Visconti (Continued)

FOREIGN PATENT DOCUMENTS

WO WO 00 16863 A1 3/2000
WO WO 01 37163 A1 5/2001
WO WO 2006/043255 A2 4/2006

OTHER PUBLICATIONS

PCT Search Report in PCT/US2010/52308, dated Nov. 23, 2010 (Feldman, et al.).

(Continued)

*Primary Examiner* — Ryan Zeender
*Assistant Examiner* — Dana Amsdell
(74) *Attorney, Agent, or Firm* — Lee & Morse, P.C.

(57) ABSTRACT

A restaurant system may include multiple booths in at least part of a restaurant and a central computer in communication with each booth. Each booth may include a table having a table display, seating stations arranged around the table, the table being large enough to accommodate dining at each seating station, a wall having a wall display therein, the wall display positioned to be viewable from all seating stations, the wall display configured to display a common image, the table display configured to control the wall display, a booth computer in communication with the table display, the wall display, and the central computer, and an access point configured to allow access to restaurant workers and entry/exit to the booth.

49 Claims, 32 Drawing Sheets

(56) References Cited

U.S. PATENT DOCUMENTS

| | | | | |
|---|---|---|---|---|
| 6,920,431 | B2 | 7/2005 | Showghi et al. | |
| 6,940,394 | B2 | 9/2005 | Gagnon | |
| 6,973,437 | B1 | 12/2005 | Olewicz et al. | |
| 6,975,910 | B1 | 12/2005 | Brown et al. | |
| 6,980,999 | B1 | 12/2005 | Grana | |
| 6,982,733 | B1 | 1/2006 | McNally et al. | |
| 7,069,228 | B1 | 6/2006 | Rose et al. | |
| 7,163,311 | B2 | 1/2007 | Kramer | |
| 7,254,775 | B2 * | 8/2007 | Geaghan et al. | 715/701 |
| 7,385,479 | B1 | 6/2008 | Green et al. | |
| 7,487,461 | B2 * | 2/2009 | Zhai et al. | 715/773 |
| 7,549,921 | B2 * | 6/2009 | Storm | 463/22 |
| 7,572,223 | B2 | 8/2009 | Donaldson | |
| 7,620,901 | B2 * | 11/2009 | Carpenter et al. | 715/754 |
| 7,656,393 | B2 | 2/2010 | King et al. | |
| 7,874,923 | B2 * | 1/2011 | Mattice et al. | 463/46 |
| 7,920,159 | B2 | 4/2011 | Ueno et al. | |
| 7,925,996 | B2 * | 4/2011 | Hofmeister et al. | 715/863 |
| 7,976,372 | B2 * | 7/2011 | Baerlocher et al. | 463/12 |
| 7,980,858 | B2 | 7/2011 | Valoe et al. | |
| 8,046,701 | B2 * | 10/2011 | Chiu et al. | 715/761 |
| 8,147,316 | B2 * | 4/2012 | Arezina et al. | 463/20 |
| 8,350,814 | B2 * | 1/2013 | Kim et al. | 345/168 |
| 8,368,616 | B1 * | 2/2013 | Harris | 345/1.1 |
| 8,403,740 | B2 * | 3/2013 | Kovacs et al. | 463/16 |
| 8,439,756 | B2 * | 5/2013 | Baerlocher et al. | 463/37 |
| 2003/0016844 | A1 * | 1/2003 | Numaoka | 382/100 |
| 2003/0078793 | A1 | 4/2003 | Toth | |
| 2003/0182209 | A1 | 9/2003 | Ge et al. | |
| 2003/0210277 | A1 | 11/2003 | Harada | |
| 2004/0001048 | A1 * | 1/2004 | Kraus et al. | 345/173 |
| 2005/0183023 | A1 | 8/2005 | Maruyama et al. | |
| 2005/0257160 | A1 * | 11/2005 | DeBellis et al. | 715/754 |
| 2006/0101354 | A1 * | 5/2006 | Hashimoto et al. | 715/863 |
| 2006/0125799 | A1 | 6/2006 | Hillis et al. | |
| 2007/0129150 | A1 * | 6/2007 | Crowder et al. | 463/46 |
| 2007/0171273 | A1 * | 7/2007 | Saleh et al. | 348/14.08 |
| 2007/0236478 | A1 * | 10/2007 | Geaghan et al. | 345/173 |
| 2007/0247435 | A1 * | 10/2007 | Benko et al. | 345/173 |
| 2007/0257891 | A1 | 11/2007 | Esenther et al. | |
| 2007/0291710 | A1 | 12/2007 | Fadell | |
| 2008/0022328 | A1 * | 1/2008 | Miller | 725/86 |
| 2008/0113767 | A1 * | 5/2008 | Nguyen et al. | 463/25 |
| 2008/0171602 | A1 * | 7/2008 | Patel et al. | 463/42 |
| 2008/0198138 | A1 * | 8/2008 | McFarlane et al. | 345/173 |
| 2008/0214273 | A1 * | 9/2008 | Snoddy et al. | 463/19 |
| 2009/0084612 | A1 * | 4/2009 | Mattice et al. | 178/18.04 |
| 2009/0085894 | A1 | 4/2009 | Gandhi et al. | |
| 2009/0088203 | A1 | 4/2009 | Havens et al. | |
| 2009/0122022 | A1 * | 5/2009 | Park et al. | 345/173 |
| 2009/0143141 | A1 * | 6/2009 | Wells et al. | 463/37 |
| 2009/0183098 | A1 * | 7/2009 | Casparian et al. | 715/765 |
| 2010/0083109 | A1 * | 4/2010 | Tse et al. | 715/702 |
| 2010/0097342 | A1 | 4/2010 | Simmons et al. | |
| 2010/0106607 | A1 * | 4/2010 | Riddiford et al. | 705/15 |
| 2010/0113140 | A1 * | 5/2010 | Kelly et al. | 463/25 |
| 2010/0118112 | A1 | 5/2010 | Nimri et al. | |
| 2010/0193258 | A1 | 8/2010 | Simmons et al. | |
| 2011/0293094 | A1 | 12/2011 | Os et al. | |
| 2011/0296508 | A1 | 12/2011 | Os et al. | |
| 2013/0127688 | A1 * | 5/2013 | Amiya et al. | 345/2.3 |
| 2013/0132885 | A1 * | 5/2013 | Maynard et al. | 715/777 |

OTHER PUBLICATIONS

Steelecase: Media:scape brochure, © 2010.

European 1st Examination Report for EP 08832576.6 dated May 17, 2013.

International Search Report for PCT/US2012/021777 dated May 8, 2012, Feldman, et al.

Extended European Search Report; EP 08832576.6 dated Feb. 29, 2012.

* cited by examiner

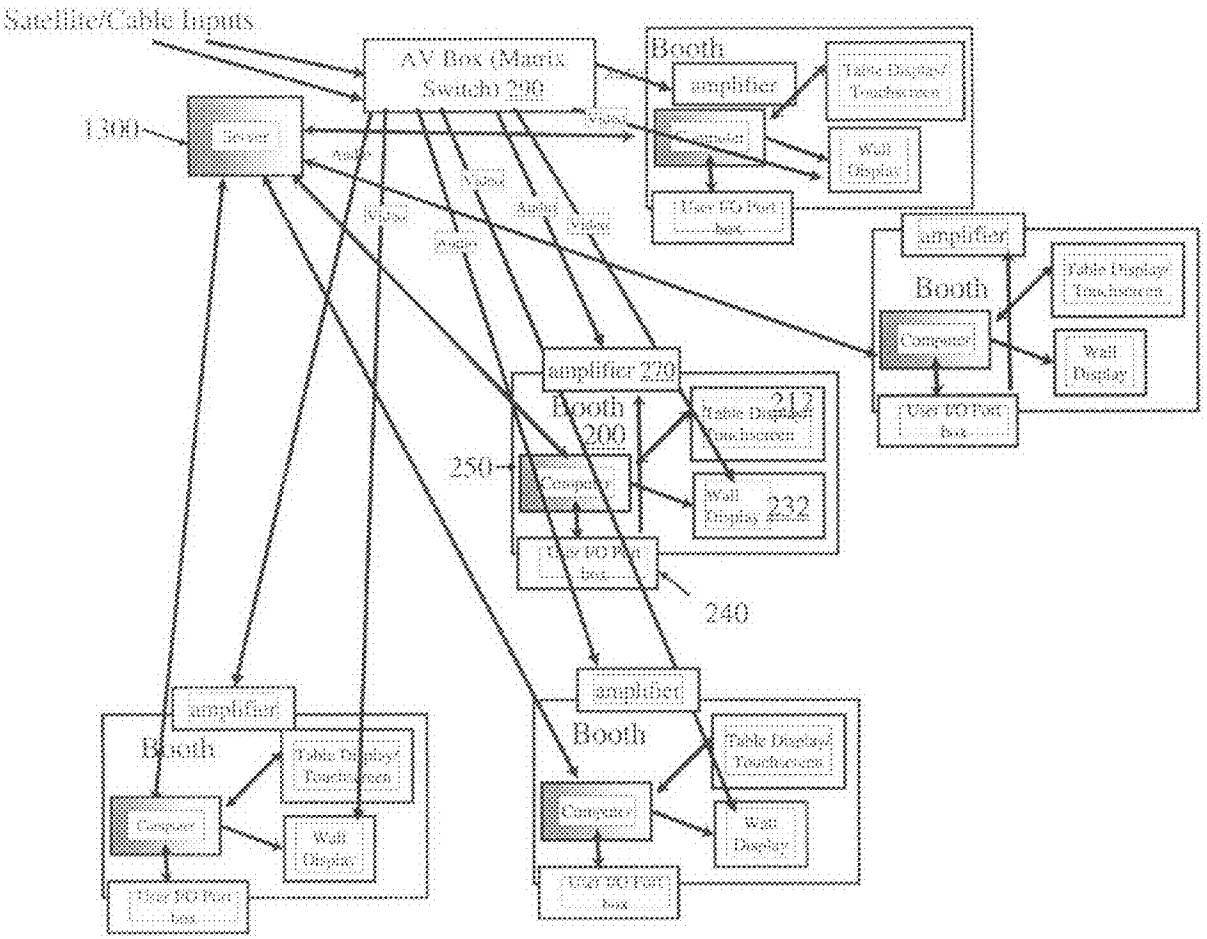
Satellite/Cable Inputs
AV Box (Mini Switch) 200
Booth
Booth
Booth
Booth
Booth
Amplifier 210
Amplifier
Amplifier
Amplifier
Amplifier
Video Cable
Audio Cable
Video Cable
Audio Cable
Video Cable
Audio Cable

MULTIMEDIA DISPLAY, MULTIMEDIA SYSTEM INCLUDING THE DISPLAY AND ASSOCIATED METHODS

CROSS-REFERENCE TO RELATED APPLICATION

The present application claims priority under 35 U.S.C. §119(e) to U.S. Provisional Application Ser. No. 60/994,458, entitled "Multimedia Restaurant and Booth", filed on Sep. 20, 2007, which is hereby incorporated by reference in its entirety for all purposes.

BACKGROUND OF THE INVENTION

1. Field of the Invention

Embodiments may be directed to a restaurant system and booth therefore, in which at least some of the tables in a restaurant include the booth, which has both a table display in a table thereof and a wall display on a wall thereof. Embodiments may also be directed to methods for use in a restaurant system, such as ordering using the table display, real-time information regarding menu items, and customizing environments for the booth.

2. Description of the Related Art

Current systems allow current restaurant customers to conduct video conferencing in a restaurant setting, allow prospective restaurant customers to remotely request reservations, allow prospective restaurant customers to remotely order items, and allow restaurant owners to monitor and manage workflow. However, no completely interactive restaurant experience has yet been introduced.

SUMMARY OF THE INVENTION

Embodiments are therefore directed to a booth, a restaurant system including multiple booths and associated methods, which substantially overcome one or more of the disadvantages of the related art.

At least one advantage may be realized by providing a booth, including a table having a table display, seating stations arranged around the table, the table being large enough to accommodate dining at each seating station, a wall having a wall display therein, the wall display positioned to be viewable from all seating stations, the wall display configured to display a common image, the table display configured to control the wall display, a computer in communication with the table display and the wall display, and an access point configured to allow access to restaurant workers and entry/exit to the booth.

The booth may include sound isolation features partially surrounding at least one booth. The sound isolation features may include a partition associated with at least one booth. The partition may be higher than about four feet.

The booth may include speakers configured for the booth, the table display being configured to allow control of audio signals output by the speakers within the booth. The speakers may be in each seating station. The speakers may be in a ceiling above in each booth.

The table display may be configured to divide the table display into a number of sub-screens, each sub-screen being oriented appropriately for each seating station. At least two sub-screens may display an electronic menu from which items are selected. The wall display may be configured to display selected items, e.g., in a bottom portion thereof.

A user may select the number of sub-screens to be displayed on the table display. The table display may be configured to display a server sub-screen oriented to be viewed from the access point.

The computer may be a booth computer. The booth computer maybe hard wired to at least one of the wall display and table display. The booth may include a connector configured to connect a user's device to the booth computer, the user's device being at least one of a laptop computer, a memory card, a flash memory drive, a storage device, an audio device, and a video device.

The table may be a conventional dining table height and seating stations at least partially fit under the table. The table display is configured to provide a sub-screen oriented for the access point. The table display may be a touch screen.

The booth may include a connector configured to connect a user's device to at least one of the wall display and the table display. The user's device may be at least one of a laptop computer, a memory card, a flash memory drive, a storage device, an audio device, and a video device. The user's device may be connected only to the wall display computer. The table display may be configured to allow a user to switch at least one of a source of video displayed on the wall display and a source of audio to speakers from the computer to the user's device.

The table display may be flush with a top of table.

The table display may be configured to allow a user to view and select photographic images for display on the wall display. The photographic images may form a slideshow on the wall display. A source of the photographic images may be at least one of a user device, the computer, and an internet connection.

The table display may be configured to allow a user to control visual information on the wall display, to control audio information within the booth and to view and select from an electronic menu in a restaurant where the booth is located. Items selected from the electronic menu on the table display may be displayed on the wall display and visible from the access point. The wall display may visually indicate selected items are ready to be ordered.

At least one advantage may be realized by providing a booth, including a table, seating stations arranged around the table, the table being large enough to accommodate dining at each seating station, a wall having a wall display therein, the wall display positioned to be viewable from all seating stations, speakers configured to output audio signals within the booth, a plurality of sources including a computer in communication with the wall display and at least one port configured to connect a user's device to the wall display, a device configured to allow a user to select a source from the at least one source for at least one of video signals for the wall display and audio signals for the speakers, and an access point configured to allow access to restaurant workers and entry/exit to the booth.

The device may be a remote control. The source may be previously loaded content on the computer. The previously loaded content may be loaded through the at least one port. The user's device may be at least one of an audio/video player and a laptop computer. The computer may be a booth computer.

At least one advantage may be realized by providing a booth including a table having a table display, seating stations arranged around the table, the table being large enough to accommodate dining at each seating station, wherein the table display is configured to divide the table display into a number of sub-screens, each sub-screen being oriented appropriately for each seating station, at least one sub-screen displaying an electronic menu from which items are selected, and an access point configured to allow access to restaurant workers and entry/exit to the booth.

The table may provide enough clearance for a seated user to place their knees under the table. The at least one sub-screen may be configured to display user selected content and another one of the sub-screens controls the at least one sub-screens. The number of sub-screens may include at least one control sub-screen configured to control images displayed in at least one viewing sub-screen of remaining sub-screens. The viewing sub-screen may expand to fill more than one sub-screen up to an entirety of the table display. The images displayed may be at least one of still images and video images supplied by a user. The table display may include a touch-screen.

At least one advantage may be realized by providing a method of providing an interactive booth, the method including arranging seating stations around a table, the table being large enough to accommodate dining at each seating station and having a table display, positioning a wall display to be viewable from all seating stations, the wall display configured to display a common image, the table display configured to serve as an input device for the wall display, and providing an access point configured to allow access to restaurant workers and entry/exit to the booth.

At least one advantage may be realized by providing a restaurant system, including a booth including a display configured to display an electronic menu to a user, and a central computer in communication with the booth, the computer configured to collect data to form a database including information regarding correlations between items in the electronic menu, search the database in accordance with a selected item selected by the user, and display recommended menu items based on the selected item on the display.

Data for the database may be collected by surveying customers. The display in the booth may be configured to survey customers. The selected item may be historical for the user. The selected item may be a user preference. The selected item maybe a food item and the recommended item may be at least one of a complimentary drink item, a complimentary food item, and a similar food item.

At least one advantage may be realized by providing a restaurant system, including multiple booths in at least part of a restaurant, and a central computer in communication with each booth, each booth including a table having a table display, seating stations arranged around the table, the table being large enough to accommodate dining at each seating station, a wall having a wall display therein, the wall display positioned to be viewable from all seating stations, the wall display configured to display a common image, the table display configured to control the wall display, a booth computer in communication with the table display and the wall display, and an access point configured to allow access to restaurant workers and entry/exit to the booth.

BRIEF DESCRIPTION OF THE DRAWINGS

The above and other features and advantages will become more apparent to those of ordinary skill in the art by describing in detail exemplary embodiments thereof with reference to the attached drawings, in which:

FIG. 13 illustrates a network system in accordance with an embodiment; and

DETAILED DESCRIPTION OF EMBODIMENTS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

As used herein, the term "user" may refer to either a customer or a restaurant employee.

Multimedia Restaurant System Overview

Figure 1:
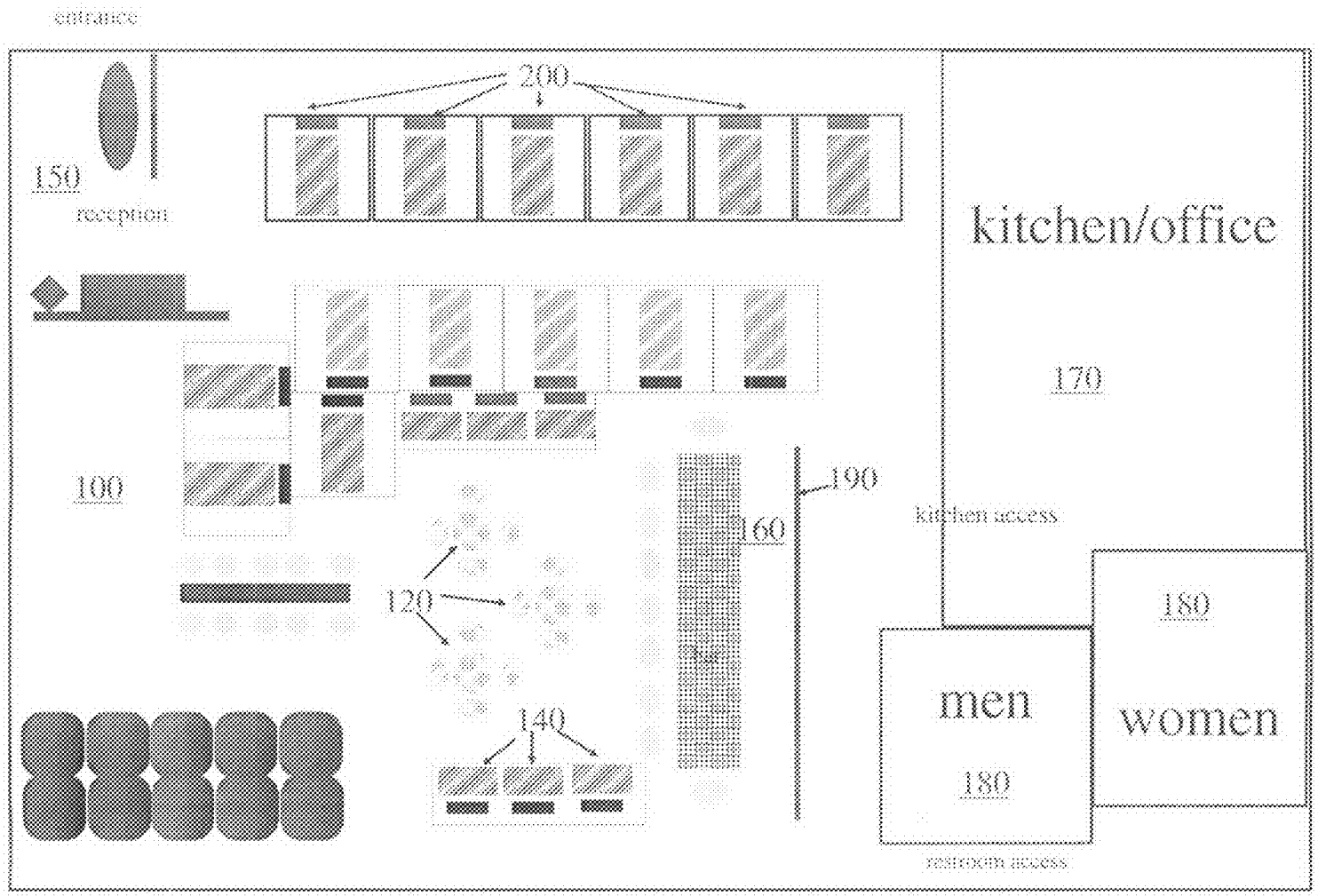
FIG. 1 illustrates a floor plan of a restaurant system, including a plurality of booths, in accordance with an embodiment.

As illustrated in FIG. 1, a multimedia restaurant system 100 may include multimedia booths 200, conventional tables 120, and individual computer stations 140 arranged in a floor plan. The multimedia restaurant system 100 may also include other conventional amenities, e.g., a reception area 150, a bar 160, a kitchen/office 170, restrooms 180, and a separator 190 obscuring a view of the kitchen/office 170 and the restrooms 180 from the remainder of the restaurant.

Multimedia Booths

Figure 2A:
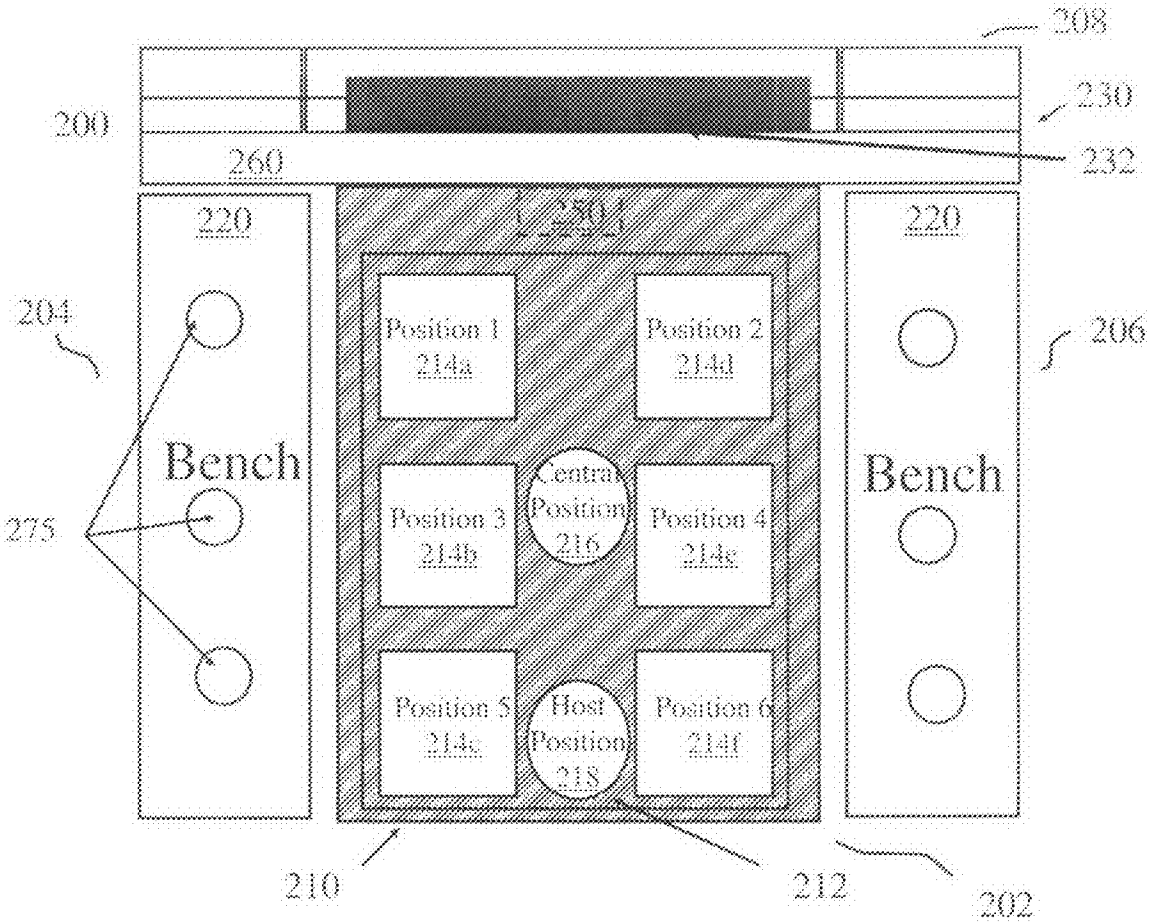
FIG. 2A illustrates a plan view of a booth in accordance with an embodiment.
Figure 2B:
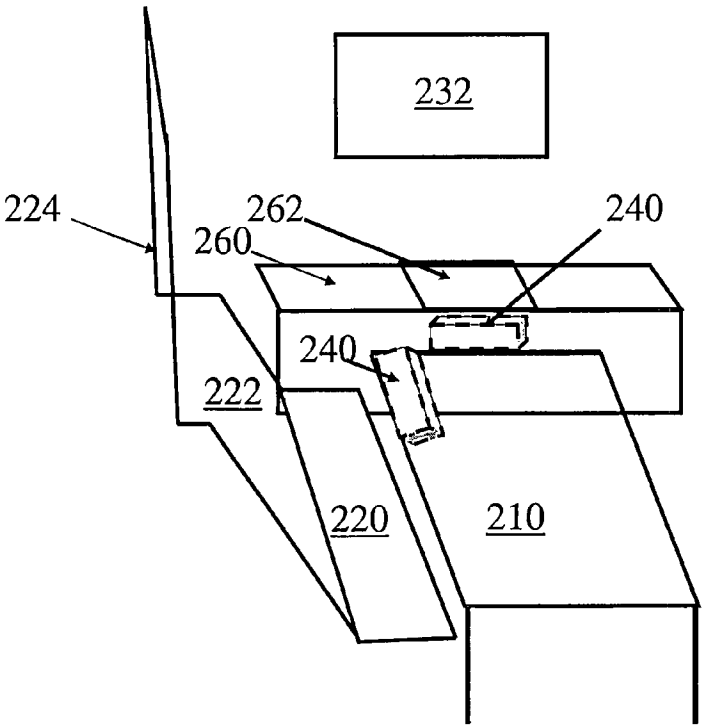
FIG. 2B illustrates a partial perspective view of a booth in accordance with an embodiment.

As illustrated in FIGS. 2A and 2B, each multimedia booth 200 may include a table 210, seating 220 and at least one wall 230. One side 202 or a portion thereof may be open and may serve as an entrance to the booth 200. At least one side 204, 206 of the booth 200 may have seating 220, e.g., chairs or benches. Another side 208 of the booth 220 may include the wall 230 that has a wall display 232 thereon. The wall display 232 may be viewable from all positions in the seating 220.

All closed sides, e.g., 204, 206, 208 may be built so that they are higher than normal restaurant booths and/or have less open space to reduce the sound coming from any locations in the restaurant outside of the booth 200, and may be treated with additional known sound proofing and/or audio enhancing techniques. For example, typical heights of backs of the seating stations are between 36-42 inches, while embodiments envision increased privacy without being too enclosed and may include having heights of backs 222 of the seating 220 greater than about 50 inches, e.g., 54 inches. These backs 222 may include the cushioning for the seating 220. Additionally, a partition 224, e.g., a transparent partition, may extend upwards from the back 222, e.g., up to the ceiling.

Further, closed sides adjacent seating 220, e.g., sides 204, 206, may include speakers 275 associated with each seating therein. These speakers may be designed so that the sound emanating from the speakers may be louder inside the booth 200 and quieter outside the booth 200, including neighboring booths. Alternatively, the speakers 275 may be incorporated into the seat backs of the seating 220. Alternatively or additionally, speakers 275 may be above the seating 220, in the ceiling, in the side walls 204, 206, and/or in the wall display 232. The speakers 275 may be directional speakers with the sound directed toward locations near ears of those seated in seating 220 in the booth 200.

Alternatively, the closed sides, e.g., 204, 206, 209 may have conventional restaurant heights. Typically, the displays in these booths may be solely for visual purposes, e.g., no audio may be output.

The table 210 may be suitable both for eating and interacting with electronic media, and may include a table display 212, e.g., a touch screen. Interacting with electronic media may include any of the following: viewing photos on an electronic display, editing photos, viewing videos, editing videos, listening to personal music, ordering food, obtaining information about food, searching the web, telephone conferencing, paying for food or other services, video conferencing, playing video games. The table display 212 may cover most of the table 210, as indicated by the outline on the table 210, and/or may be divided into a plurality of regions, individual positions 214*a* to 214*f*, e.g., corresponding to seating positions, a central position 216 and a host position 218.

As illustrated in FIG. 2A, each booth 200 may include two displays, i.e., the table display 212 and the wall display 232. Both displays may be connected to a booth computer 250. The table display may 212 serve as an input device for the wall display 232. As discussed in detail below, the wall display 232 may display customizable environments. The booth computer 250 may include a box containing a processor and other components, e.g., storage devices, graphics cards and I/O ports. such as in typical computers, e.g., a Mac Mini® or Mac Pro® made by Apple, Inc. The booth computer 250 may include two graphics cards and two video cards for respectively driving the table display 212 and the wall display 232. The booth computer 250 may include an amplifier to allow further control of audio/video outputs to the wall display 232. Alternatively, the amplifier may be external to the booth computer 250, as discussed below in FIG. 2J. The booth computer 250 may be built into the wall display 232.

The booth 200 may further include a storage area 260 for a user's device and connection jacks to enable direct hard wired connection of the user's device to the booth computer 250 or the wall display 232. The storage area 260 may be a shelf between the end of the table 210 and the wall display 232. For example, the storage area 260 may be a shelf so the user's device may be stored horizontally or vertically. In the case of horizontal storage, the shelf may be arranged so the user may use the keyboard or other input mechanism of the user's device. For example the storage area 260 may be between 6 inches and 14 inches wide, may be a same height as or higher than the table 210. This makes the storage area 260*t* wide enough to place a user's device up to the size of a typical laptop on the storage area 260 to the side of the wall display 232. Additionally or alternatively, as illustrated in FIG. 2B, the storage area 260 may include an access door 262, e.g., a hinged or sliding door, providing access to cables via an I/O port box 240 allowing connection to the booth computer 250 and/or the wall display 232.

An infrared (IR) transmitter may be connected to the booth computer 250, as discussed below with reference to FIG. 12J. The IR transmitter may be hidden from view from the user. The IR transmitter may be stored underneath the seating stations 220 and located near the booth computer 250 so that the IR transmitter may be directly connected to the booth computer. The IR transmitter may be controlled by the booth computer 250 to send IR signals to the wall display 232 in a manner that emulates the remote control for the wall display 232. The IR transmitter may also be configured to send IR signals to the amplifier or the amplifier can be connected directly to the booth computer. In this manner a user can control functions normally provided by conventional remote controls by tapping the table display. Inputs to the display may be routed to the booth computer 250 that may operate the IR transmitter to effectively operate as a remote control.

The user I/O port box 240 may be on at least one of a side of the table 210, under the table 210, on the wall 200, in the wall 200, on the storage area 260, or under the storage area 260. As illustrated in FIGS. 2B, the booth 200 may include more than one I/O port box, e.g., the I/O port box 240 under the table 210 and the I/O port box 240 under the storage area 260.

Figure 2C:
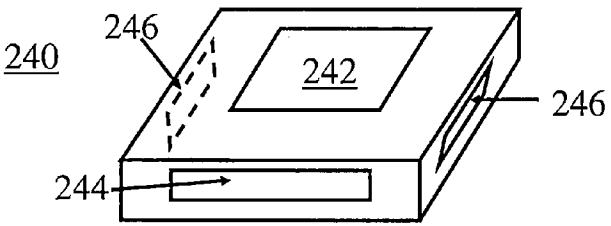
FIG. 2C illustrates a schematic perspective view of an I/O port in accordance with an embodiment.
Figure 2D:
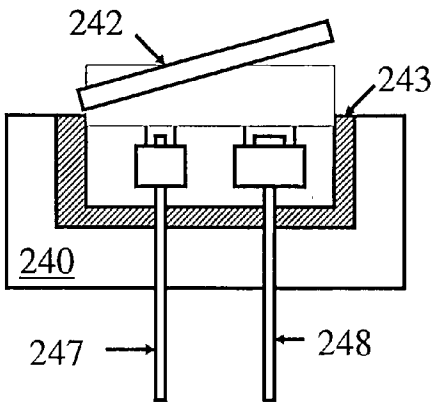
FIG. 2D illustrates a schematic sectional view of an I/O port in accordance with an embodiment.

As illustrated in FIGS. 2C and 2D, each user I/O port may include a USB port 244, power outlets 246, and multiple cables, e.g., a VGA cable 247 and an Ipod®/Iphone® cable 248, a door 242 covering the multiple cables, and a removable section 243 through which the cables may extend. Additionally or alternatively, each user I/O port box 240 may include external ports for various types memory cards or other storage devices, a digital video interface (DVI) cable, an audio cable, a docking station for a laptop, a wireless connection, an Ethernet connection, blue tooth or wifi, and so forth. When a user's device is connected, this connection may allow the laptop to use the wall display 232 as a display, but may not connect to the booth computer 250 itself.

Alternatively or additionally, a USB card reader may be an external device that is connected to the booth computer 250. This external USB card reader may be mounted on the wall near the wall display 232 (e.g., under the wall display 232 and above the table). This external USB card reader may be connected to a USB port on the booth computer 250 and may allow any flash memory, camera memory, thumb drive, and so forth, to be connected to the booth computer 250.

As illustrated in FIG. 2A, the table display 212 may include first through sixth individual positions 214*a*-214*f*. Initially, the table display 212 and/or the wall display 242 may be in a logo mode, in which a still logo, a moving logo, nothing (blank screen), video animation of the logo, or other still image or video may be displayed. Initially, the table display 212 may display a single screen over an entire surface thereof.

Once the table display 212 has been touched in any of the individual positions 214*a*-214*f*, that individual position may display an initial menu mode (IMM). Other individual positions that have not been touched may continue to display individual images present in the logo mode, or may also display the IMM. Additionally or alternatively, touching the host position 216 may display the IMM in all individual positions.

Alternatively, an entirety of the table display 212 may be centered around the location of the touch that activates the screen. As a further alternative, display of the table display 212 may be re-positioned or re-sized by dragging the window within the table display 212.

The table display 212 may be set in to any of several "functional modes." Functional mode examples include single person mode, two person mode, four person mode, six person mode, full mode, and so forth. The examples described above assumed six person seating. In the four person mode, the table display 212 may be divided into quadrants. In two person mode, the table display 212 may be divided into halves, e.g., one region may be oriented towards the person on the left side of the table 210 and the other region to the person on the right side, and so forth. In the full mode and in the two person mode, a button may be provided to allow rotation of the display. Tapping this rotate button may cause the display to be rotated so that if the person viewing the display is on the other side, the display can be rotated to the correct orientation, or, if two people are sitting on opposite sides of the table, one person may rotate their display to show to the other person.

When a region is in IMM, if the table display 212 is not touched within a particular individual region after a short period of time (the IMM timeout period), then the corresponding region may revert back to the logo mode. If all regions are in logo mode, then an image or video covering a large portion or substantially all of the table display 212 may be displayed. Otherwise, if at least one region is activated, then the regions that are not activated may display the logo mode.

The automatic abandonment of IMM may allow the following operations to be realized. First, if a user accidentally touches the table display 212, the IMM menu may disappear after the IMM timeout period. Second, if a glass or plate is placed on a region in Logo mode, the corresponding region may be placed in IMM mode, but after a short period of time revert back to the logo mode. Third, if a user decides not to enter anything electronically, then their menu will disappear.

The regions not being used may remain in the logo mode. Then, any time a region in the logo mode is accidentally activated, the region may only be activated for the IMM Timeout Period and then revert back to the logo mode. This may not the case for lower level menus. For example, if a region in the IMM is accidentally touched in a position corresponding to a lower level menu, that region of the table display 212 may display that lower level menu and the corresponding timeout period may be significantly longer or non-existent. Every time the screen is "tapped" the computer may interpret such as tap as receiving a mouse click, i.e., each tap is a click. When a section goes past the timeout period with no clicks it goes in to logo mode. If the table display 212 is in the logo mode, the table display 212 may return to a previous section displayed, before going to sleep. Then, if there are no clicks registered for a short timeout period, the table display 212 may go back to sleep. The long timeout period may only be used if the table display 212 wakes up and then there is a click registered that triggers an action. That is, if the click happens outside of any positions corresponding to an action, the click may be ignored. A click on a position that causes the menu to move or change the table display 212 in some manner may be considered an action.

All of the above may assist in providing a user interface that is easy to use and intuitive to understand. Displaying multiple screens at one time may be confusing to users. Therefore, display of minimal information needed to prompt a user for input may be provided.

The table display 212 in the table 210 may allow glasses and dishes to be placed on it and may be easily cleaned. One such touch screen may sense vibrations in the glass when the glass is tapped. This touch screen may have difficulty in distinguishing between a finger tap and a tap that occurs when an object is placed on the screen. However, an object that is placed on the glass and remains on the touch screen will not continuously trigger the touch screen sensor. Such a vibration table may be thinner than other types of touchscreens.

The table 210 may have a hole therein to receive the table display 212, which may be flush with an upper surface of the table 210. Alternatively, the table 210 may be made of a transparent material, e.g., glass. A projector may be placed underneath the table 210 to form the table display 212 on the underside of the table 210. The table 210 may be a touch screen display, e.g., either single touch or multi-touch. Alternatively, the table display 212 may be mounted in one section of the table 210, or a top of the table 210 may be transparent in one section of the table 210. If the table 210 or a section of the table 210 is transparent, then the table display 212 may be projected on to the underside of the table 210, or a display, e.g., an LCD display may be mounted underneath the table 210 and viewed through the transparent table 210 or portion thereof.

Any of the above configurations of the table display 212 may allow conventional dining table and seating heights to be realized. In other words, a seated user typically will be able to fit their knees under the table The table display 212 may serve as a control screen for the wall display 232. A user may use the table display 212 to determine the images to be shown on the wall display 232. That is, the table display 212 may be used for typing, editing and finding files, moving files, various control functions, and so forth. The wall display 232 may be used for viewing and displaying images, videos, text, and so forth. Alternatively, multiple users may use the table display 212. Touch screen controls may be built into both the table display 212 and the wall display 232.

As a further alternative, the table display 212 may be mounted on top of the table 210, such that the table 210 does not need to be transparent. Thus, the table display 212 may be mounted vertically, may be a pop-up display, or may be built into the top of the table 210.

The table display 212 and the wall display 232 may be electronic displays, e.g., LCDs, plasma screens, projection displays or DLP's, i.e., any display technologies that may be used for flat panel TV's or computer monitors.

Booth States

The booth 200 may have a plurality of states associated therewith to aid in the restaurant flow. The states may only be viewable by restaurant staff, e.g., at a point of service (POS) station. States may be indicated by a number and/or a color: Examples of states may include:

0: Booth ready, no one seated;

1: Customers seated, orders not yet placed

2: Order placed, customers waiting for food;

3: Food delivered, customer not yet paid (at this point, customers may order more food, sending state of table back to state 2);

4: Bill delivered, customer not yet paid;

5: Bill paid, customers have yet left; and

6: Customers have left, table not yet cleaned.

If a booth 200 stays in one state for too long, notification may be sent to the responsible server and/or manager, e.g., to their cell phone, pager or personal digital assistant. For example, as long as all states of the booth 200 have been in a given state for a time duration less that a specified practical time, which may vary in accordance with how busy restaurant is, the particular state the booth is in, etc., the booth will be OK, e.g., may be "green". Once a booth has been in a state for longer than this specified time, the booth may switch to a warning state, e.g., may be "yellow" state. The yellow state may result in notification to the server. After another specified period in a warning state, the booth may switch to a critical state, e.g., may be "red". The red state may result in notification to the manager.

When customers are ready to place an order, they may hit a button, e.g., submit order or call server. This button may be on the table 210 separate from the table display 212 or on the wall 208 separate from the wall display 232. Additionally or alternatively, a submit order option may be placed on one or more of the menus discussed below, e.g., on the menu in FIG. 4A. Once a server comes by and verifies the order with the customers and enters it into the POS, the server may lock the order, as discussed with reference to FIG. 4E below. At this point, all the selected items so far would be become part of order 1 for the booth 200 and would become uneditable. Selecting an item after this point would become part of order 2 for the booth 200. Choosing selected items may then display two lists: order 1 and order 2, with only order 2 being alterable by the customers. Alternatively, just order 2 may be displayed, with an option to view previous order lists.

Mode Overview

Figure 3:
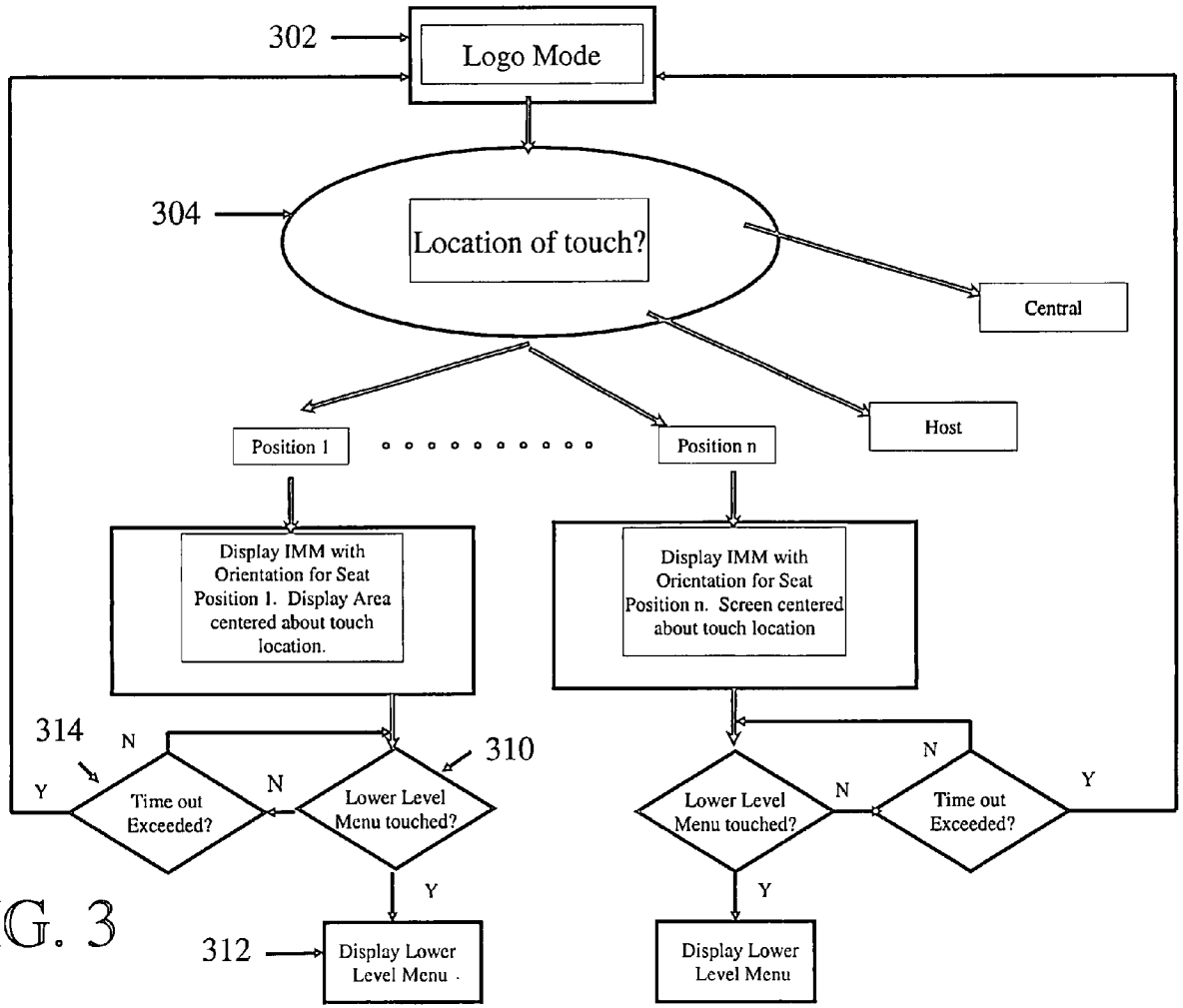
FIG. 3 illustrates a flow diagram of ordering using the table touch screen of the booth of FIG. 2 in accordance with an embodiment.

The use of the booth 200 generally will be discussed with reference to FIGS. 3-4F. FIG. 3 illustrates a flowchart of general ordering operations and FIGS. 4A to 4F illustrate examples of menus to be displayed.

As illustrated in FIG. 3, the table display 212 may default to the logo mode in operation 302. When the table display 212 is touched in operation 304, a corresponding location of the touch is determined. If the touch is in a position corresponding to a seating, the IMM may be appropriately displayed. If the touch is in a location other than a position, e.g., host or central, other menus may be displayed as discussed below. Then, in operation 310, occurrence of another touch is monitored. If another touch corresponds to selection of a lower level menu, the operation proceeds to the appropriate lower level in operation 312. If no touch is sensed, then the operation may proceed to operation 314 to determine whether a time out period has expired. If not, the operation may return to operation 310 to determine if another touch is sensed. If the time out period has expired, the operation may return to the logo mode of operation 302.

Figure 4A:
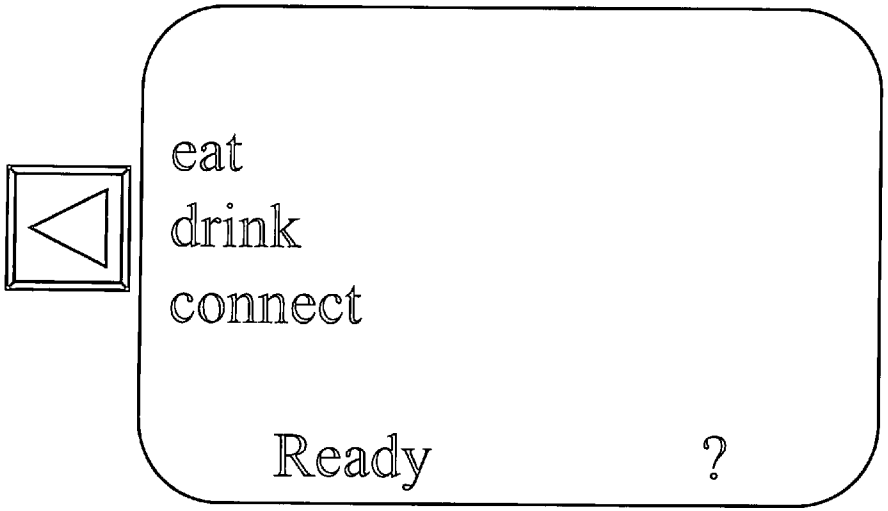
FIGS. 4A to 4F illustrate examples of menus to be displayed in accordance with an embodiment.
Figure 7:
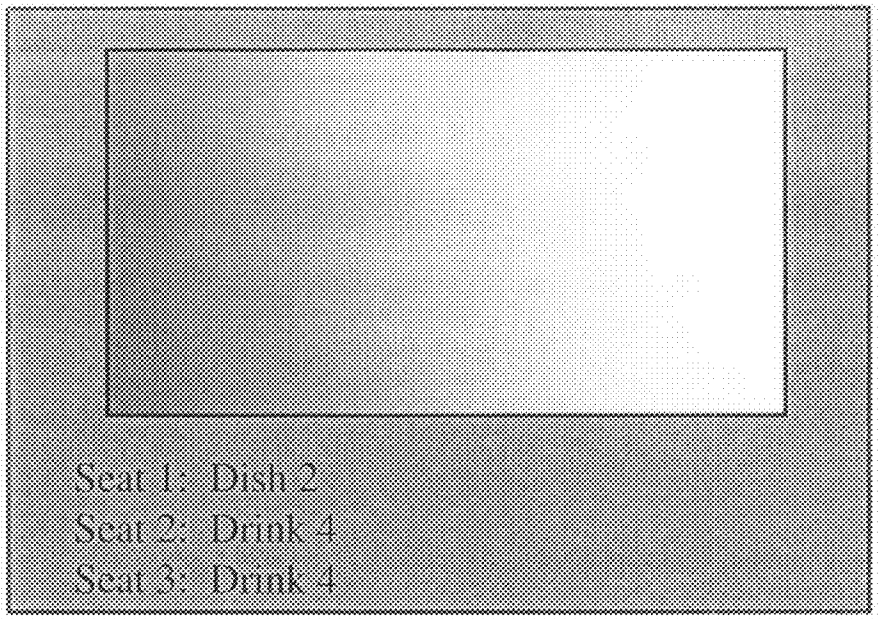
FIG. 7 illustrates a wall display after ordering in accordance with an embodiment.

FIG. 4A illustrates an example of an IMM. In the IMM of FIG. 4A, the options "eat", "drink" and "connect" may be presented. Further, "ready" and "?" may be provided in a separate portion of the menu from the three main options. When users have a question, they may hit the "?", which may remotely indicate to the assigned server that the booth 200 has a question or may visually indicated on the wall display 232 that the booth 200 has a question. For example, the wall display 232 may display, in a bottom portion thereof, a seat indicator for each position in the booth 200, as illustrated in FIG. 7. For example, these seat # may initially all be red, indicating there is no need to bother the customers in the booth 200. When "?" is selected by a customer, that seat # or all seat # may change to yellow, indicating assistance is requested. When "ready" is selected by a customer, that seat # or all seat # may change to green, indicating readiness to order. Use of visual cues on the wall display may allow any restaurant worker to attend to that booth 200.

Figure 4B:
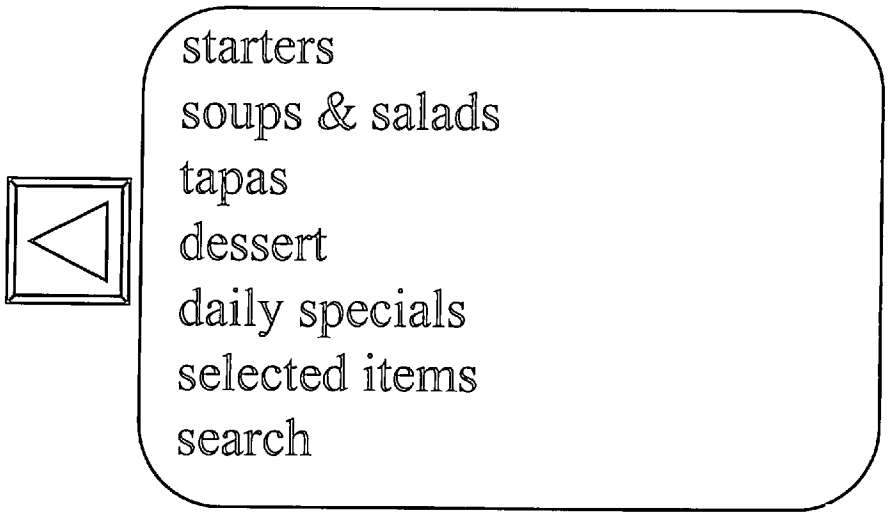
Figure 4C:
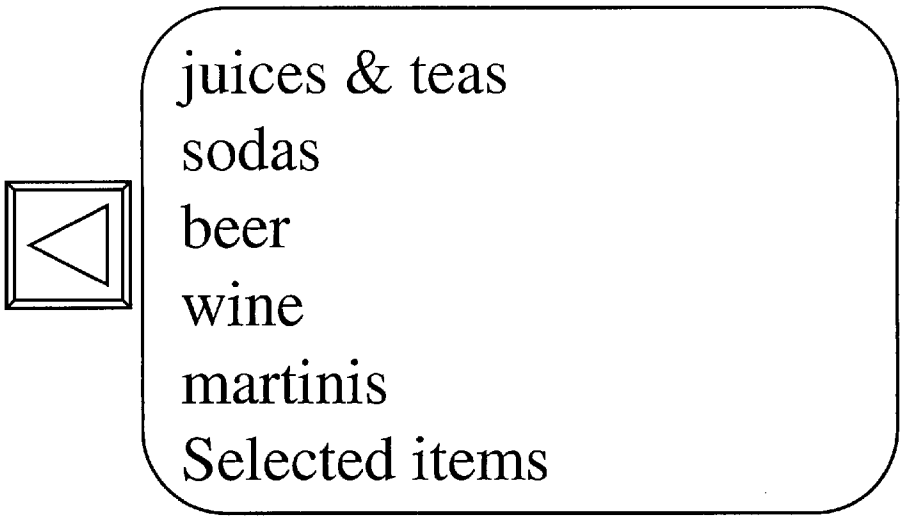
Figure 4D:
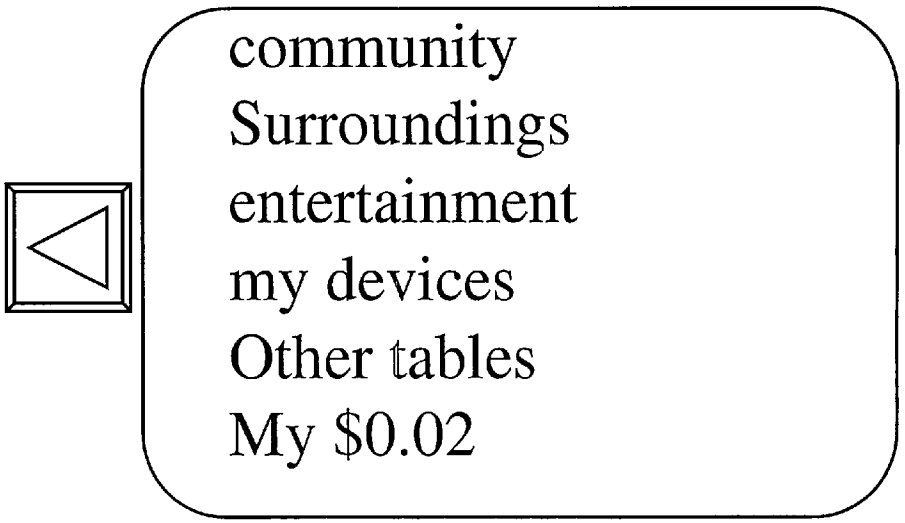

FIG. 4B illustrates an example of an eat lower level menu. FIG. 4C illustrates an example of a drink lower level menu. FIG. 4D illustrates an example of a connect lower level menu. In all FIGS. 4A to 4D, the back arrow will return the display to a previous page, e.g., IMM for the lower level menus and the logo mode from the IMM. These lower level menus will be described in detail below.

Figure 4E:
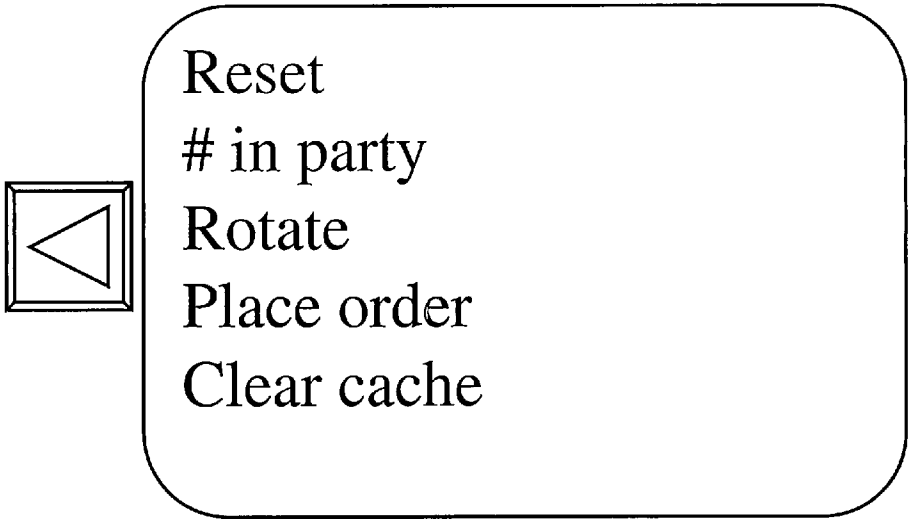
Figure 4F:
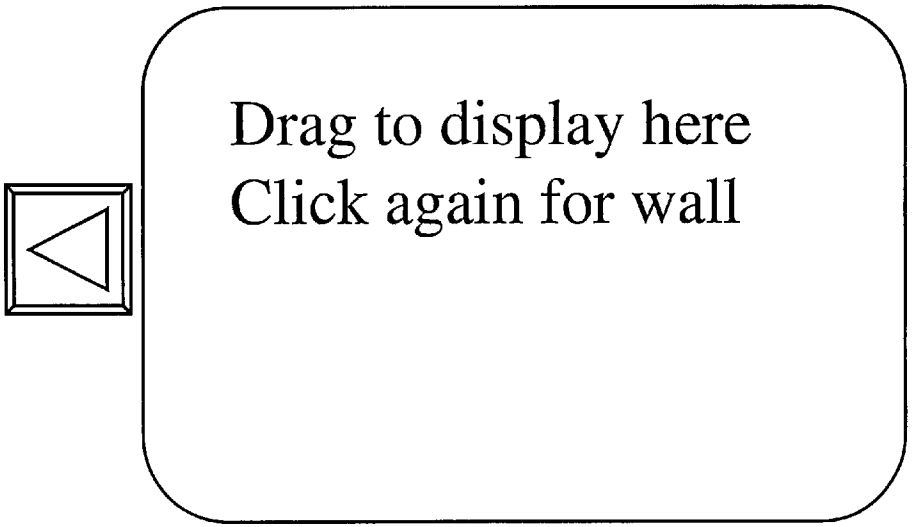

FIG. 4E illustrates an example of a host menu appearing when the host position 218 is touched. The host menu may be protected to only allow restaurant workers access. When the host touches this location various buttons may be displayed near the edge of the table 210, as illustrated in FIG. 4E, such as reset, # persons functional mode, rotate, place order and clear cache. The rotate button may allow rotation of the orientation of the menus to either side or to the end of the table 210. The reset button may erase any files that were copied onto a hard drive of the booth computer 250 during the session, sets the screen mode to logo mode, erases any food items selected and prepares the table 210 for the next customers. The place order button may allow the server to send the order to the kitchen for processing. The clear cache button may only erase all files copied onto the hard drive of the booth computer 250.

FIG. 4F illustrates an example of a central position menu, indicating how items may be displayed using the central position. In the particular example shown in FIG. 4F, images displayed in various seating positions may be dragged to the central position 216 to be displayed there and may be clicked again to display this image on the wall display 232.

Eat Mode

Figure 5A:
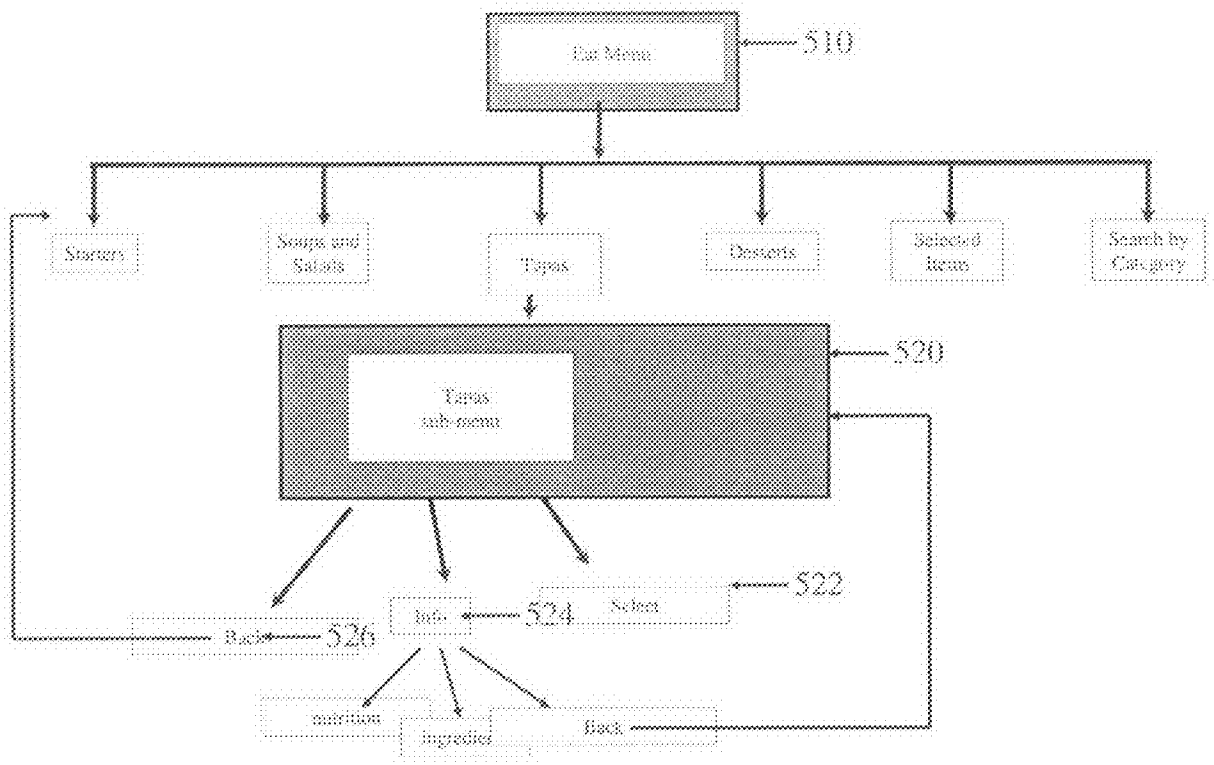
FIGS. 5*a* and 5B illustrate flowcharts for eat lower level menus in accordance with an embodiment.

Once a corresponding category of the eat lower level menu of FIG. 4B has been touched, a sub-menu corresponding to that category may appear, as illustrated in FIGS. 5A to 7. FIGS. 5A and 5B illustrate flowcharts for the eat lower level menu. FIGS. 6A to 6F illustrates examples of eat sub-menus to be displayed. FIG. 7 illustrates the wall display 232 after completion of the operation in FIG. 5A.

As illustrated in FIG. 5A, in operation 510, a category in the eat lower level is selected in operation 520. This may result in the sub-menu of FIG. 6A being displayed. As can be seen therein, "select" and "info" buttons may be next to each item Dish1 to Dishm, allowing each item to be selected or more information about each dish may be retrieved. Also, the ordered items may be listed on a bottom portion of the table display 212. Further, the ordered items may be displayed on the wall display 232, as illustrated in FIG. 7. If there are too many items to display at once, only some of these items may be displayed and up/down scroll button may be provided adjacent the list.

Figure 6A:
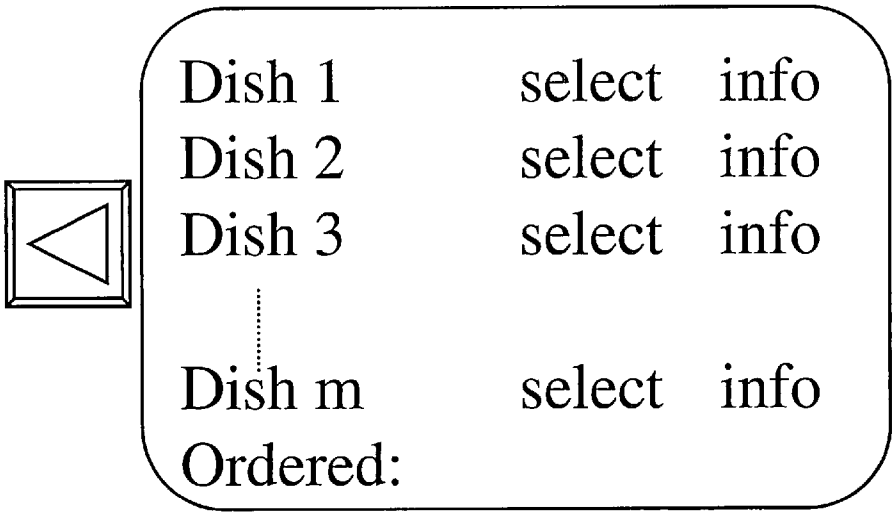
FIG. 6A to 6D illustrate an example of a generic item menu of the eat lower level menu in accordance with an embodiment.
Figure 6B:
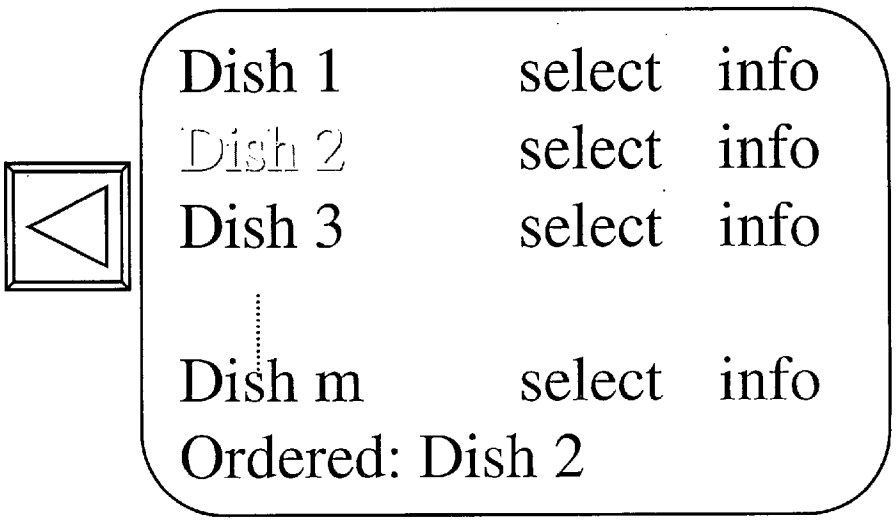
Figure 6C:
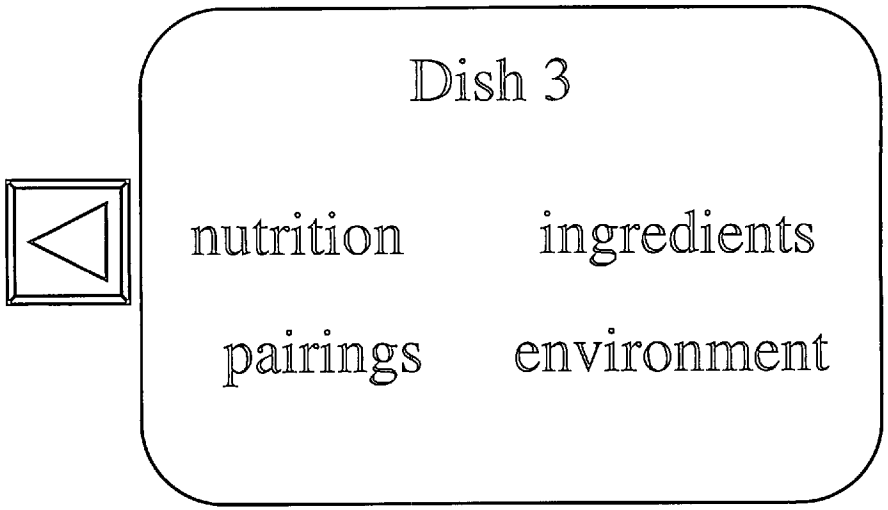

When an item is selected in operation 522, that item may be highlighted and added to the ordered items, as illustrated in FIG. 6B. When information about an item is selected in operation 524, the individual information for that item, here Dish3, may be displayed as shown in FIG. 6C. An image of that item may also be displayed. The individual information may include nutrition and ingredients, which, when touched, will display the corresponding detailed information. In addition, quantity ordered may be displayed on this screen along with buttons to increase or decrease the quantity ordered.

Alternatively, selecting a single item may cause that particular item to be highlighted, and select and info buttons, not originally displayed, to appear adjacent that item, e.g., next to the item or below it, thereby simplifying the initial sub-menu display. In addition, a short description for each item may be displayed. This may cause other items on the screen to shift position in order for all of this additional information to be displayed for the selected item. Then, if the select button is tapped, the item would be added to the selected items list and the screen may revert back to a list of the items, i.e., removal of the select and info buttons. When the info button is tapped, then a screen similar to that of FIG. 6C could be displayed as described below.

When the back button is touched in operation 526, the previous sub-menu/menu may be displayed. For example, when the back button is touched in the display may switch from the display of FIG. 6C back to the tapas sub-menu in FIG. 6B. When the back button is touched when the tapas sub-menu in FIG. 6A or 6B, the display may return to the eat lower level menu of FIG. 4B. Alternatively or additionally, a home button may be provided to return the display to the IMM of FIG. 4A.

Figure 6D:
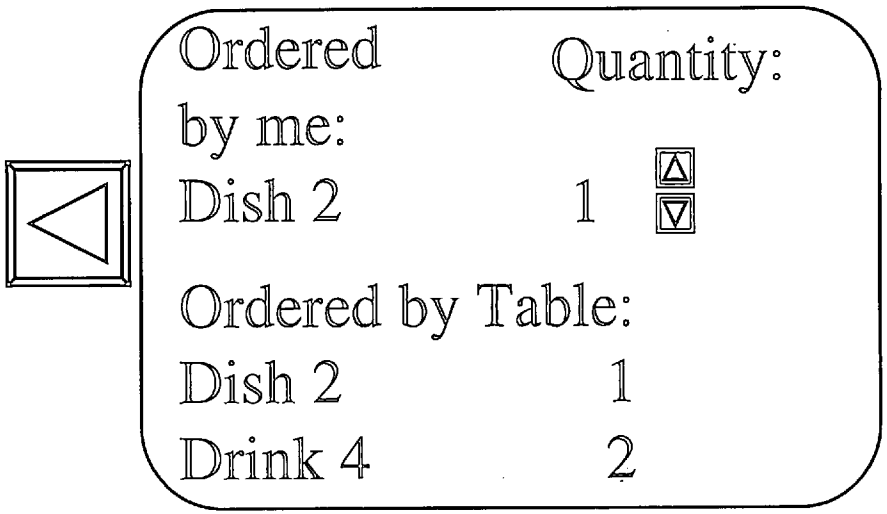

The other menu category displays may function in a similar manner. When selected items is touched, all items ordered from that position and/or all items ordered by the table and corresponding quantity ordered may be displayed, as illustrated in FIG. 6D. The quantity may be altered on this display by touching the up/down buttons therein.

Figure 5B:
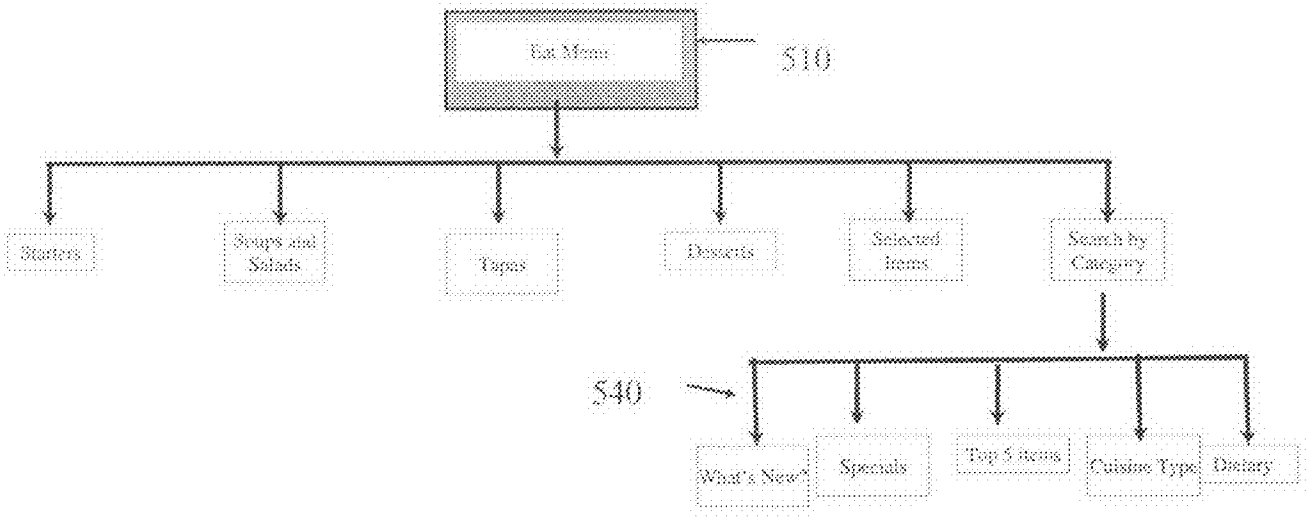
Figure 6E:
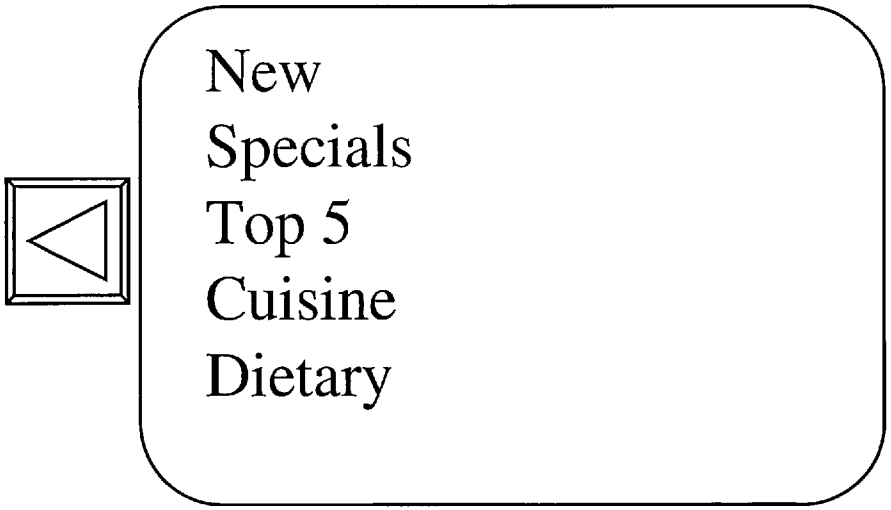
FIGS. 6E and 6F illustrate an example of a search categories generic item menu of the eat lower level menu in accordance with an embodiment.
Figure 6F:
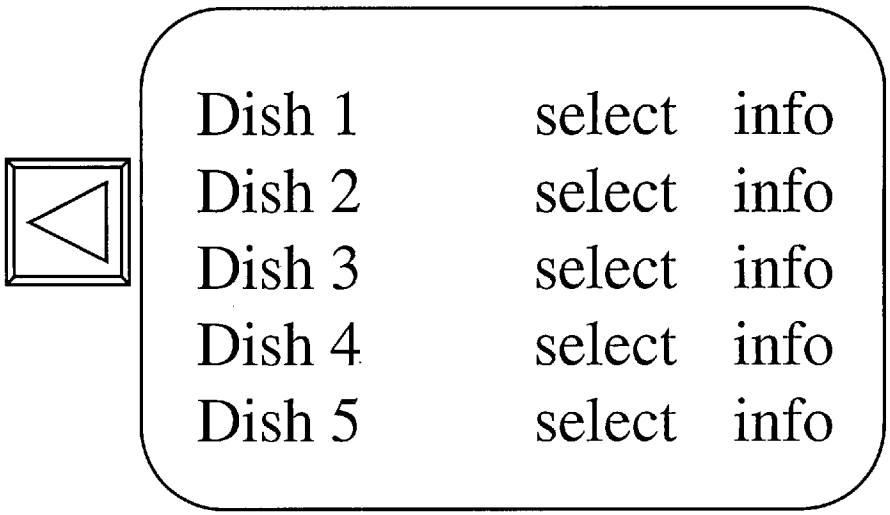

As illustrated in FIG. 5B, when the search by category is touched, another sub-menu of available searches may appear, as illustrated in FIG. 6E. Such available search options may include New, Specials, Top 5, cuisine, Dietary, and so forth. Touching one of these may display a list, as illustrated in FIG. 6F when Top 5 is selected, which may allow the corresponding dishes to be selected or for more information to be obtained. The Top 5 may include the top 5 highest rated, top 5 most frequently ordered, etc., and may be updated in real time. Alternatively, when a more detailed search category, e.g., cuisine or dietary, is selected, an intermediate display of the various sub-categories may be displayed before a corresponding display of items. For example, touching cuisine may display vegetarian, seafood, spicy, Italian, Caribbean, Spanish, South American, Asian, fusion, and so forth. Touching dietary may display vegetarian, vegan, low fat, low carb, low cal, and so forth.

Drink Mode

Figure 8:
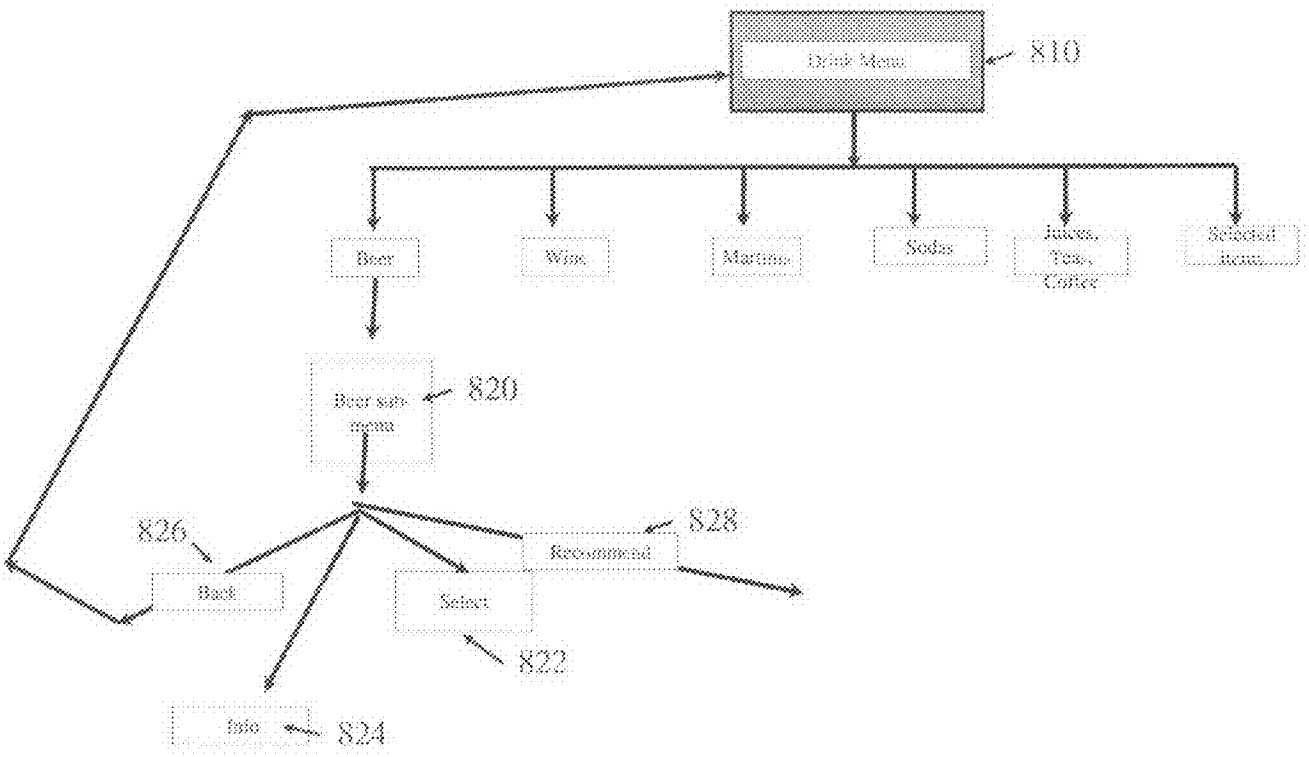
FIG. 8 illustrates a flowchart for the drink lower level menu in accordance with an embodiment.
Figure 9A:
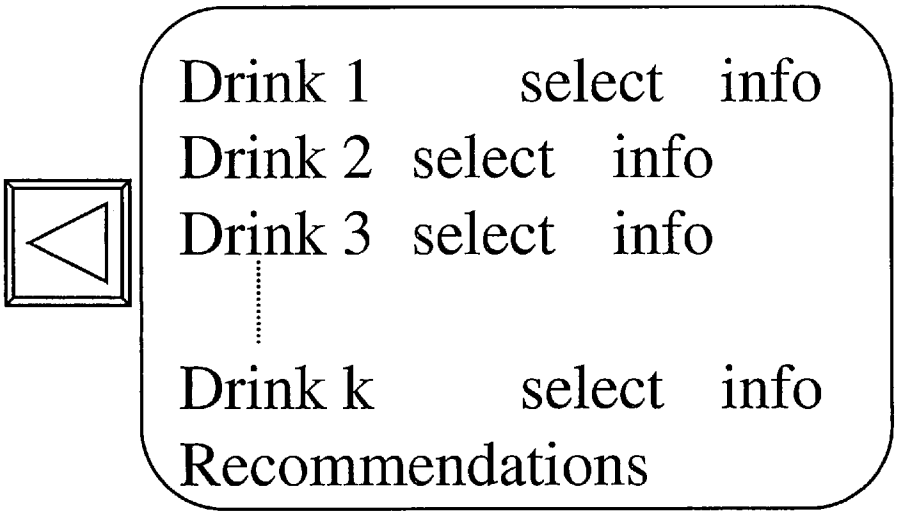
FIG. 9A to 9F illustrate examples of a generic item menu of the drink lower level menu in accordance with an embodiment.
Figure 9B:
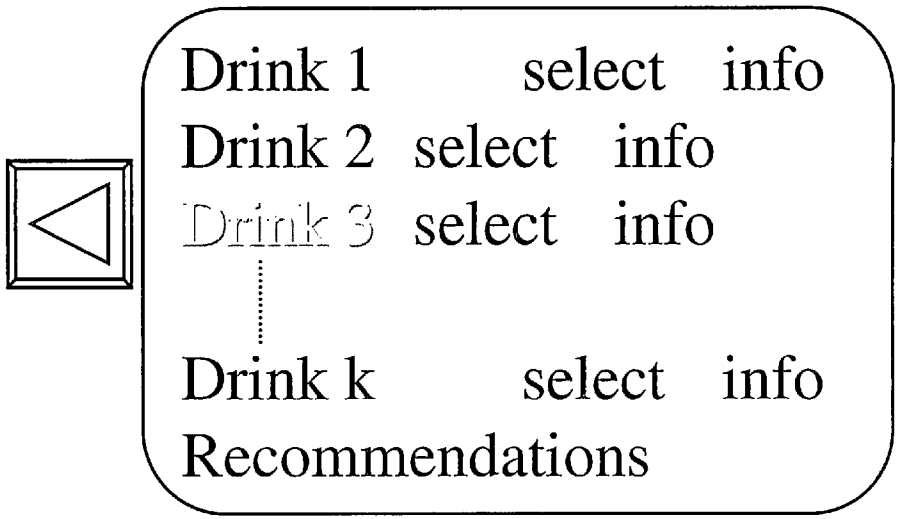
Figure 9C:
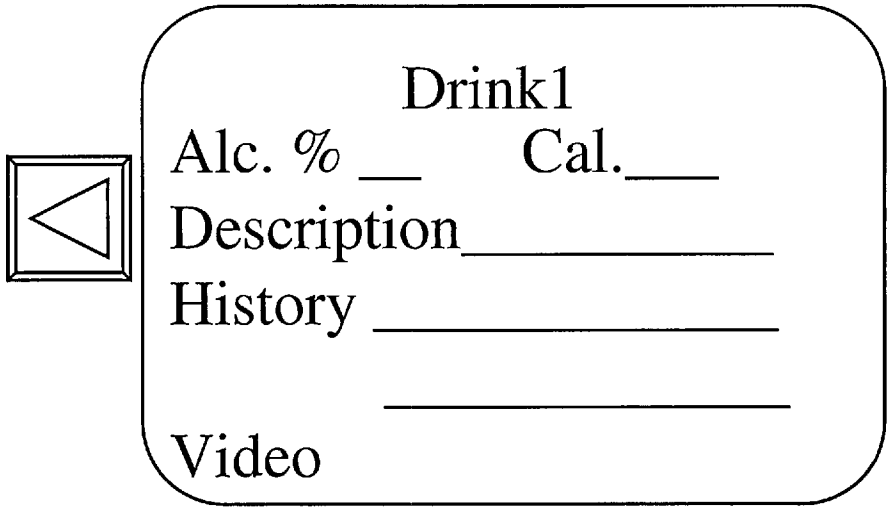
Figure 9D:
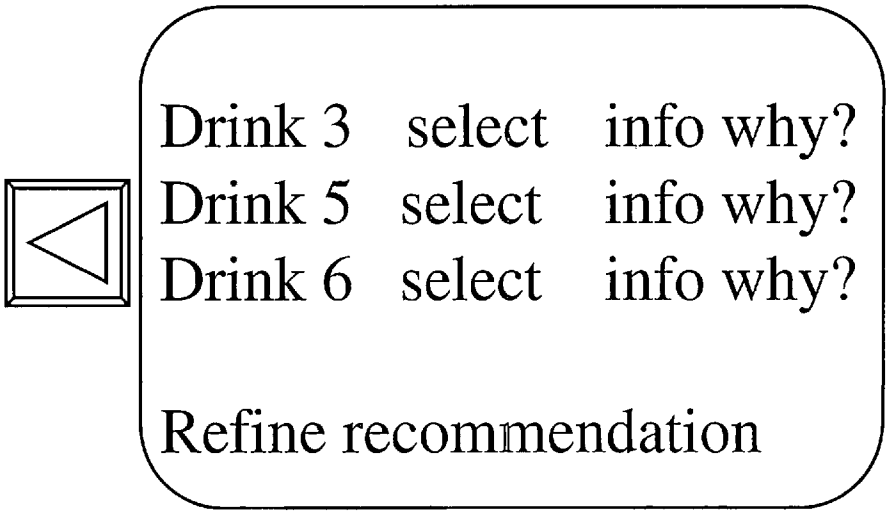
Figure 9E:
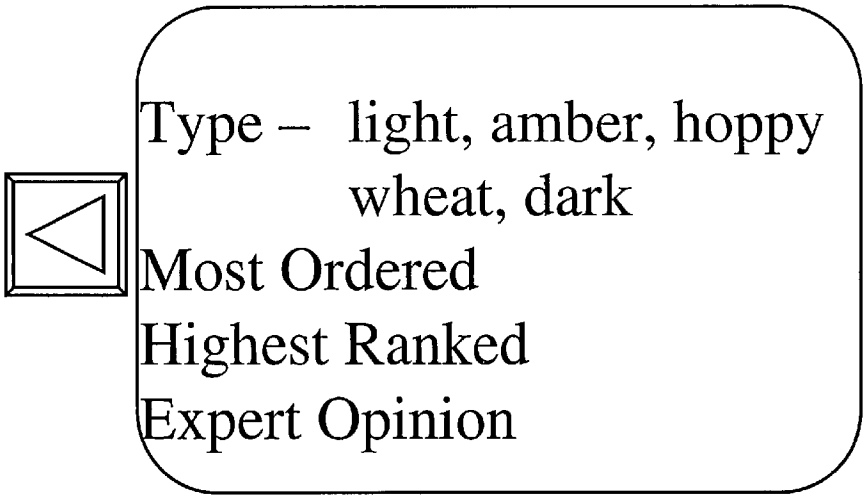
Figure 9F:
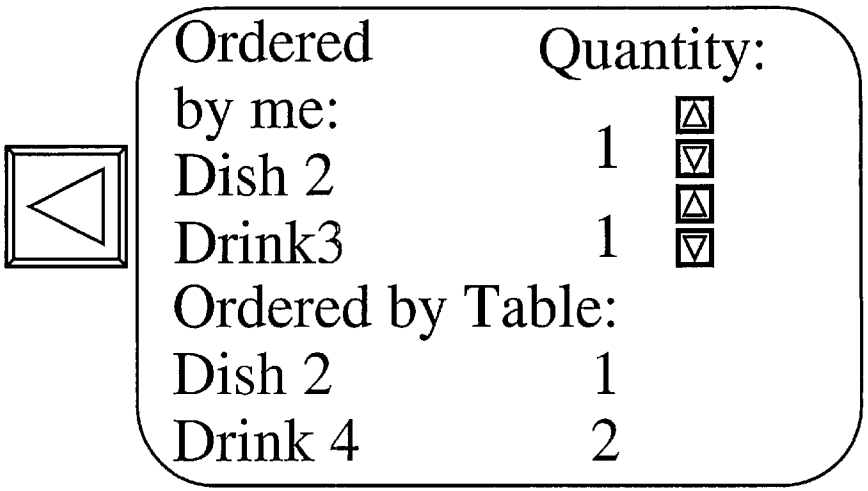
Figure 10:
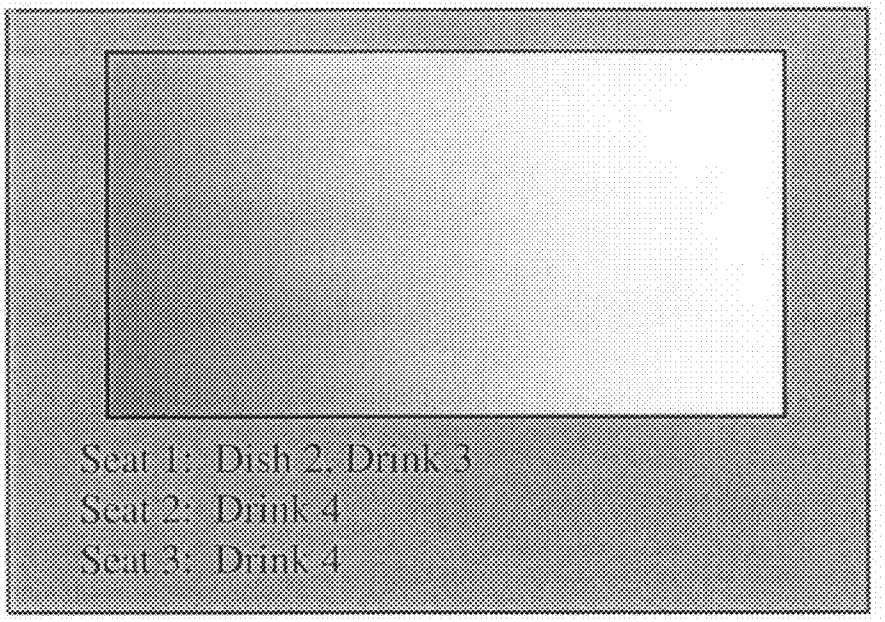
FIG. 10 illustrates a wall display after ordering in accordance with an embodiment.

Once a corresponding category of the drink lower level menu of FIG. 4C has been touched, a sub-menu corresponding to that category may appear, as illustrated in FIGS. 8 to 10. FIG. 8 illustrates a flowchart for the drink lower level menu. FIGS. 9A to 9F illustrates examples of drink sub-menus to be displayed. FIG. 10 illustrates the wall display 232 after completion of the operation in FIG. 8.

In operation 810, a category in the drink lower level may be selected in operation 820. This may result in a generic drink sub-menu of FIG. 9A being displayed. As can be seen therein, "select" and "info" buttons may be next to each item Drink1 to Drinkk, allowing each item to be selected or more information about each dish may be retrieved. Also, the ordered items may be listed on a bottom portion of the table display 212 (not shown). Further, the ordered items may be displayed on the wall display 232, as illustrated in FIG. 10. If there are too many items to display at once, only some of these items may be displayed and up/down scroll button may be provided adjacent the list.

When an item is selected in operation 822, that item may be highlighted and added to the ordered items, as illustrated in FIG. 9B. When information about an item is selected in operation 824, individual information for that item, here Drink 1, may be displayed as shown in FIG. 9C. An image of that item may also be displayed. The individual information include alcohol percentage, calories, a description of beverage, may give history of the beverage. A "video" button may be provided on this menu for a video, e.g., a video supplied by the beverage manufacturer.

The drink sub-menu may include "recommend". When a user touches recommend in operation 826, the recommend page may be displayed. This page may recommend a drink according to dish(es) ordered. For example the recommend page may display more than one drink, here three drinks as illustrated in FIG. 9D, within that category. A "select", "info" and "why" button may be provided next to each drink. The "why" button may explain why that drink was recommended. For example, any time a particular dish is ordered, several beverages may be recommended. Data for orders may be tracked at the restaurant. Any time a gazpacho is ordered, the most drink in that category also ordered by the same person or table at the same sitting may be stored and displayed, drinks based on expert opinions may be displayed, surveys may be performed to ask customers how well they like particular beverages with particular food items, and so forth.

In any of the above cases, for each food item ordered, several beverages may be identified or a beverage suitable for all food items ordered may be displayed. Each beverage may be given a "score." The score may be +1 or 0. When all food items are ordered, the Eat menu may display a button for wine recommendations. If this button is pressed, the menu may list the wine recommendations as described above in order from highest to lowest score.

Alternatively, several of the above methods may be used to determine the recommended beverages. For example, the recommend page may list drinks as recommended by the chef, most ordered, highest ranked, by other experts, type, and so forth, as illustrated in FIG. 9E. In addition, the recommendation page may also include a "refine recommendation" button to narrow or change choices or options. For example, if several drinks are displayed on the recommendation page, the "refine recommendations" button may be touched to limit the drinks to particular preferences, e.g., wines may be limited to red, white, sweet, dry, French, Australian, etc., beers may be limited to hoppy, less hoppy, dark, wheat, German, British, etc.

When the back button is touched in operation 826, the previous sub-menu/menu may be displayed. For example, when the back button is touched in the display may switch from the display of FIG. 9C back to the beer sub-menu in FIG. 9B. When the back button is touched when the beer sub-menu in FIG. 9A or 9B, the display may return to the drink lower level menu of FIG. 4C. Alternatively or additionally, a home button may be provided to return the display to the IMM of FIG. 4A.

The other menu category displays may function in a similar manner. When selected items is touched, all items ordered from that position and/or all items ordered by the table and corresponding quantity ordered may be displayed on the table display, as illustrated in FIG. 9F and/or on the wall display 232, as illustrated in FIG. 10. The quantity may be altered on this display by touching the up/down buttons therein.

Connect Mode

Figure 11:
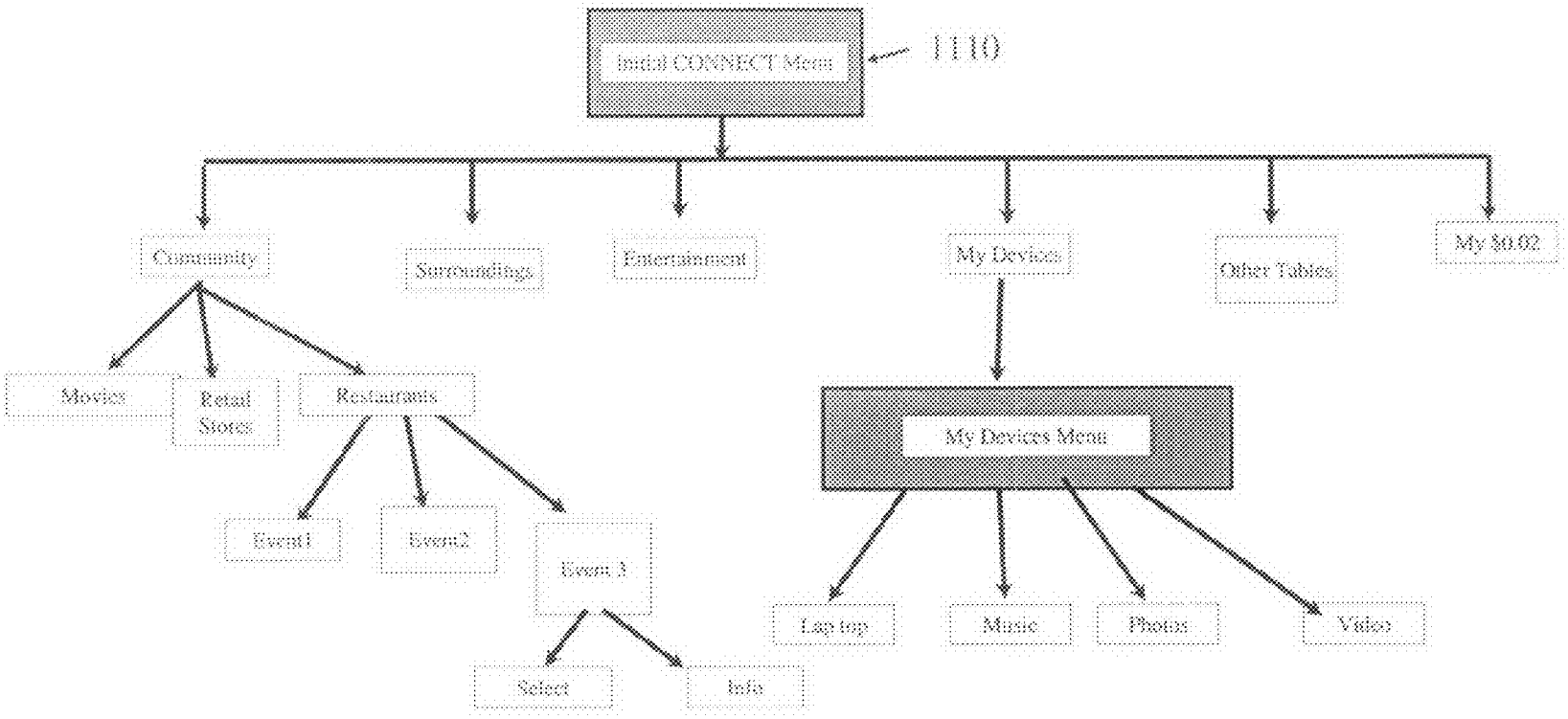
FIG. 11 illustrates a flowchart for the connect lower level menu in accordance with an embodiment.
Figure 12A:
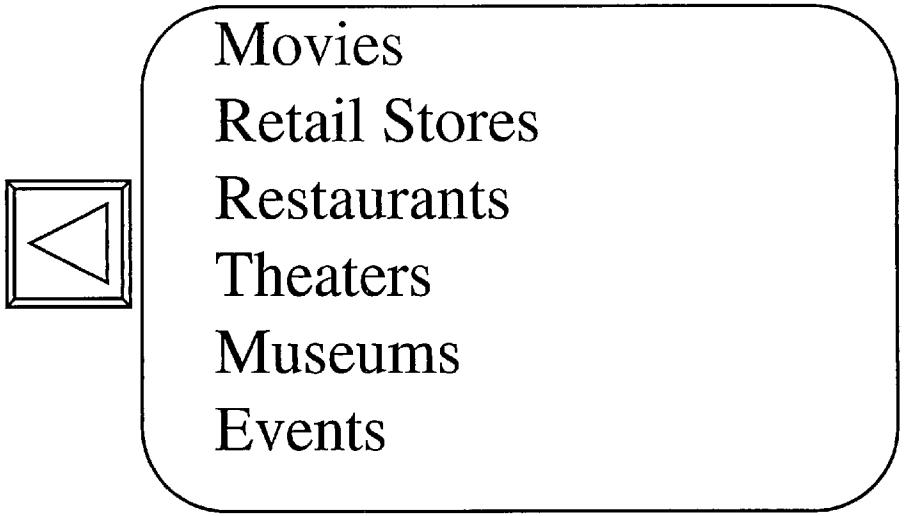
FIG. 12A to 12I illustrate an example of a generic item menu of the connect lower level menu in accordance with an embodiment.
Figure 12B:
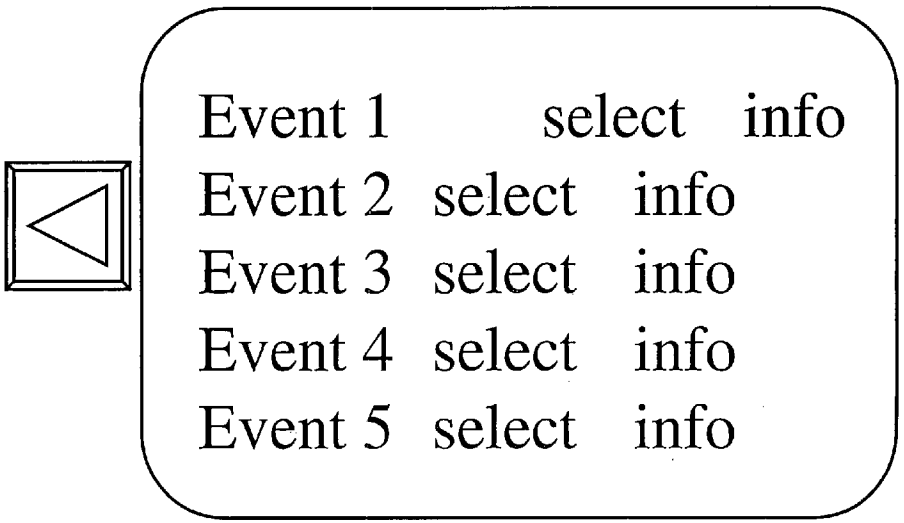
Figure 12C:
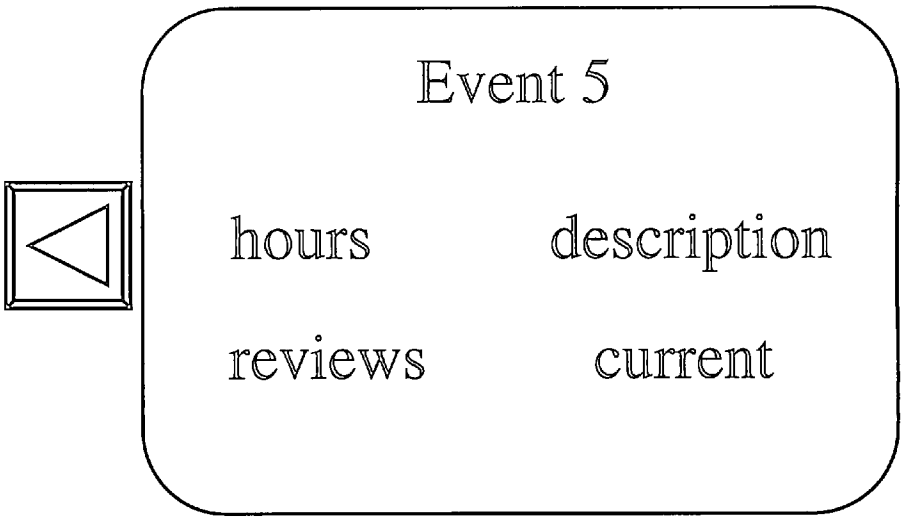
Figure 12D:
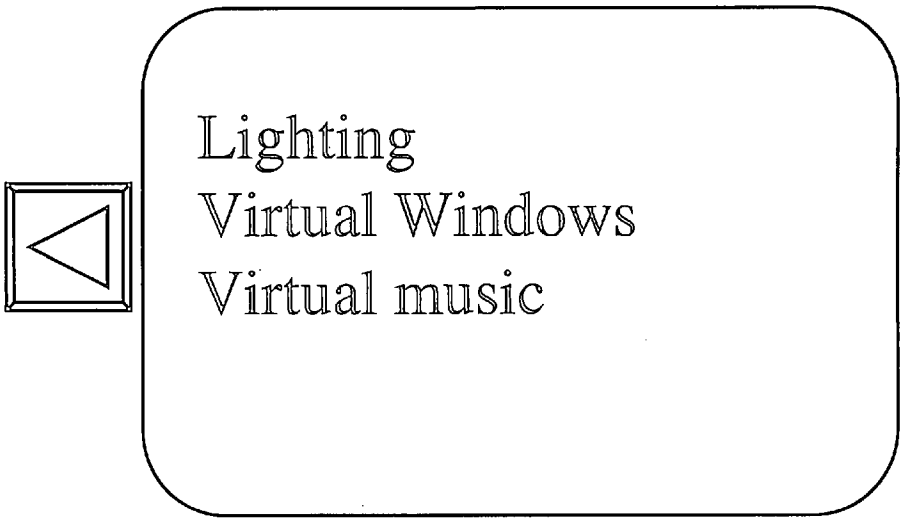
Figure 12E:
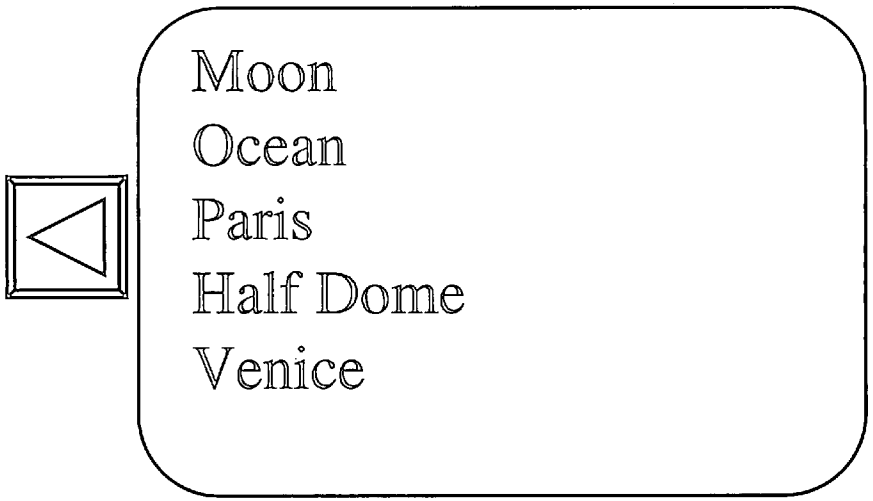
Figure 12F:
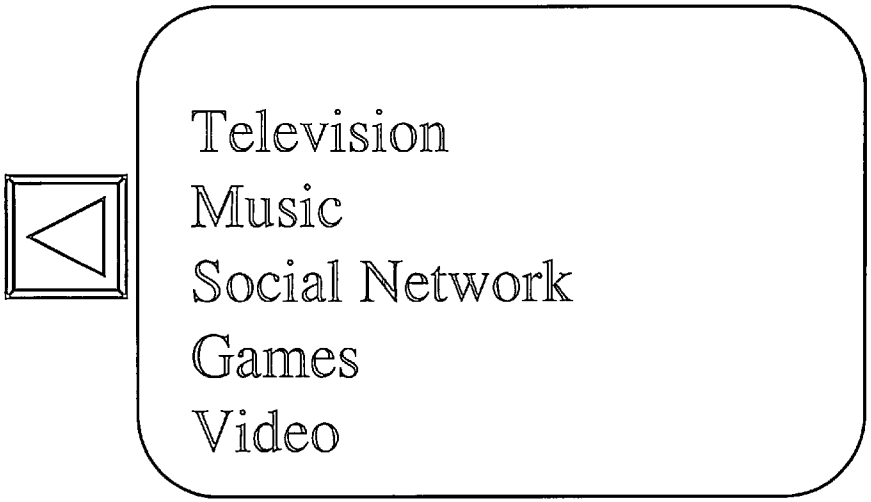
Figure 12G:
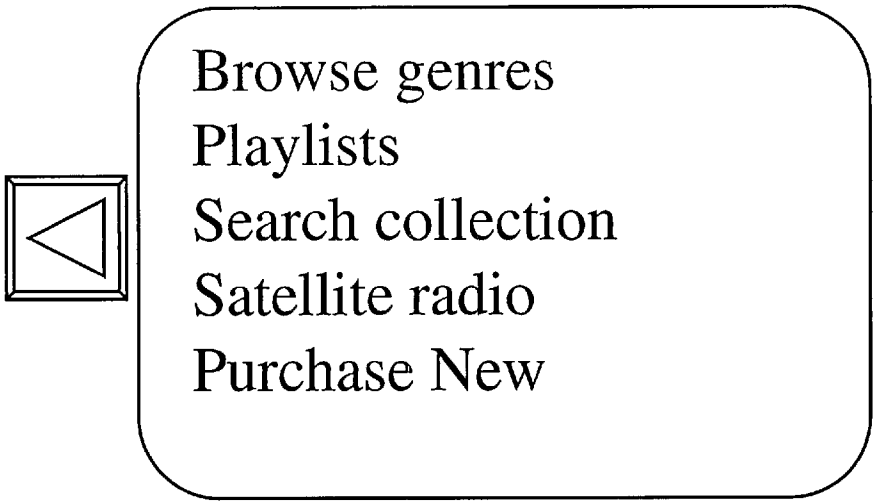
Figure 12H:
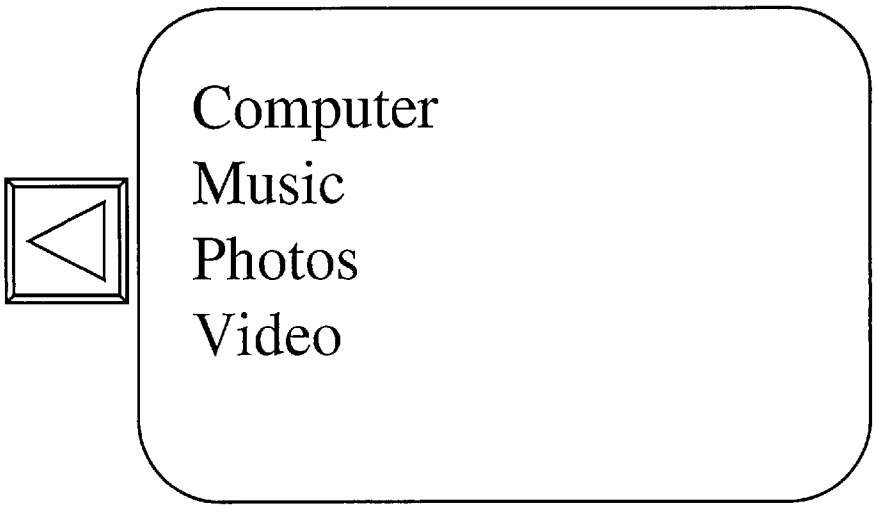
Figure 12I:
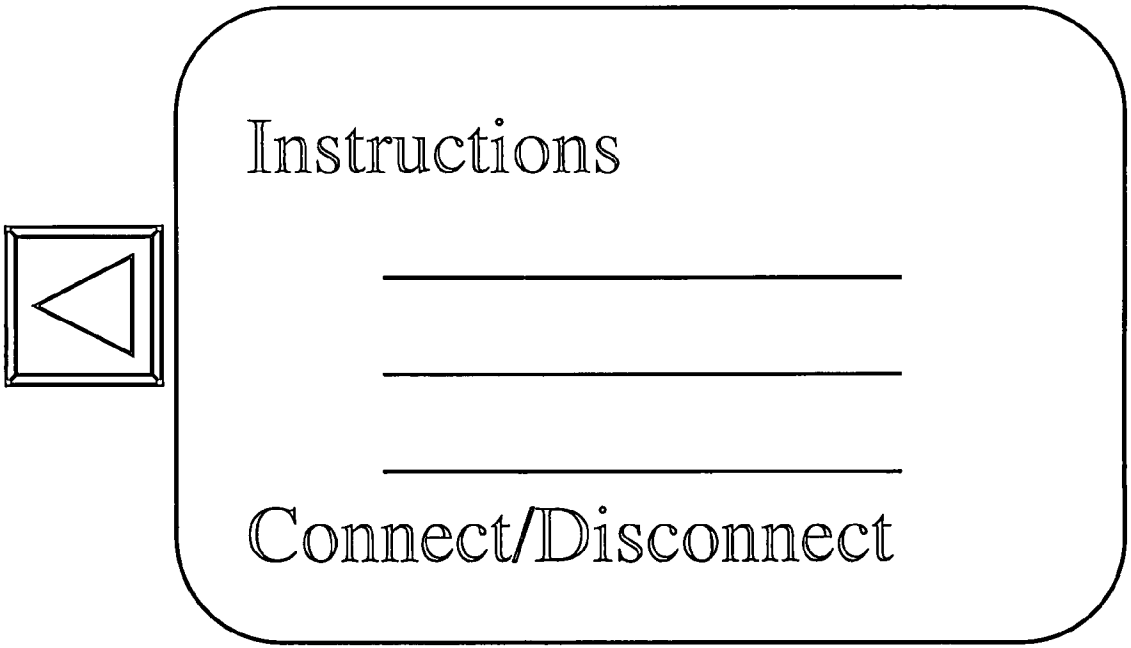
Figure 12J:
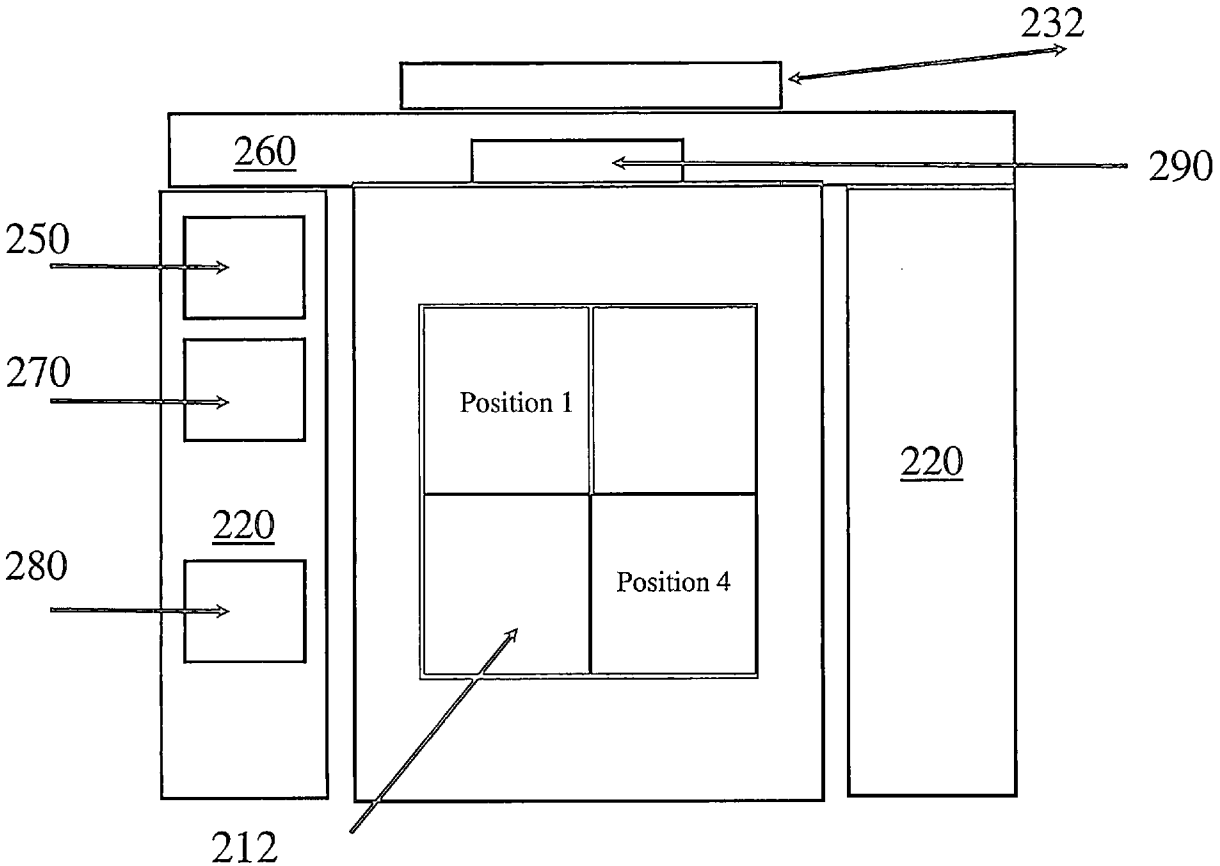
FIG. 12J illustrates a schematic plan view of a configuration for connecting user devices to the booth.
Figure 12K:
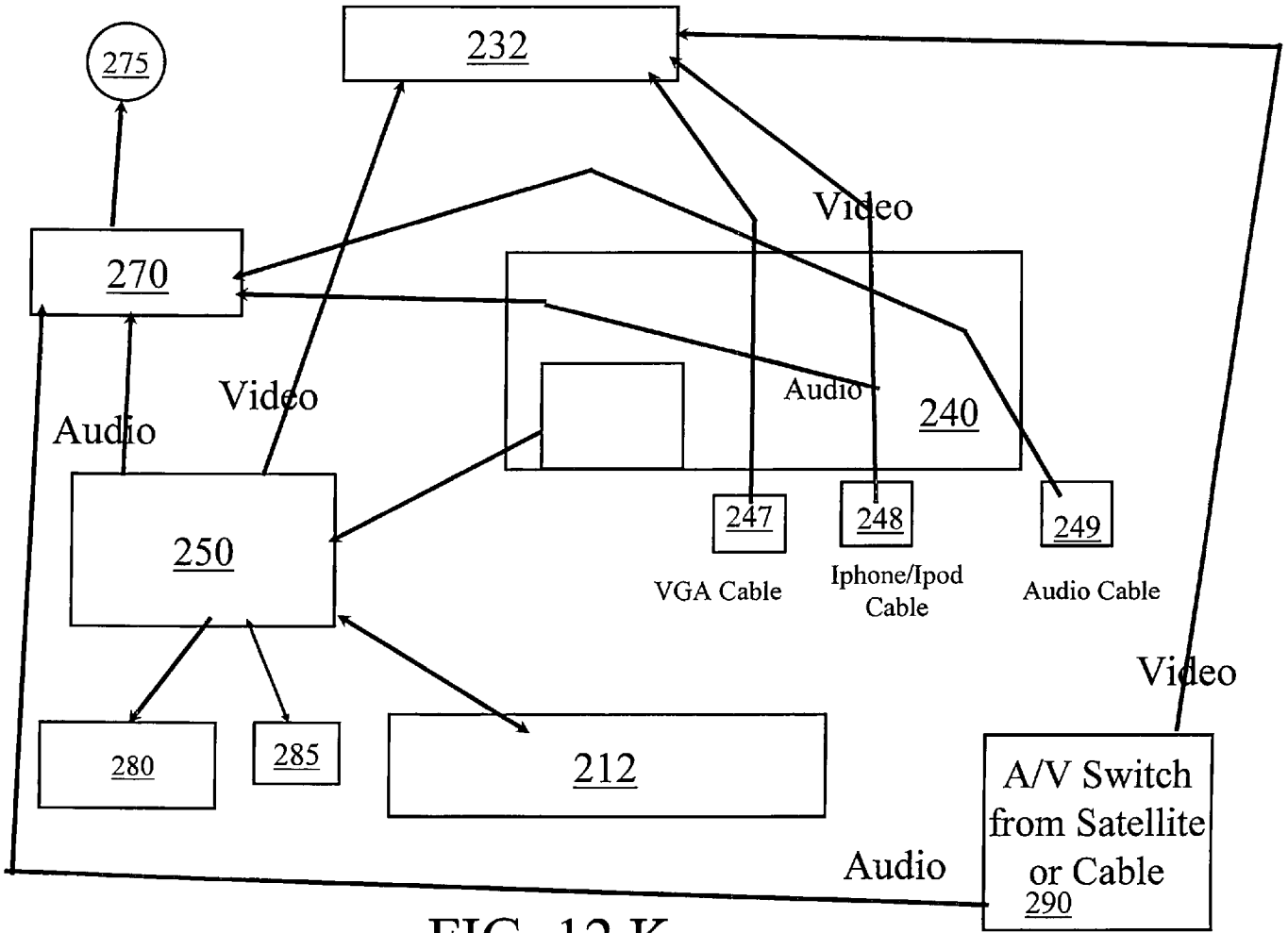
FIG. 12K illustrates a schematic relational view of the configuration of FIG. 12J.
Figure 12L:
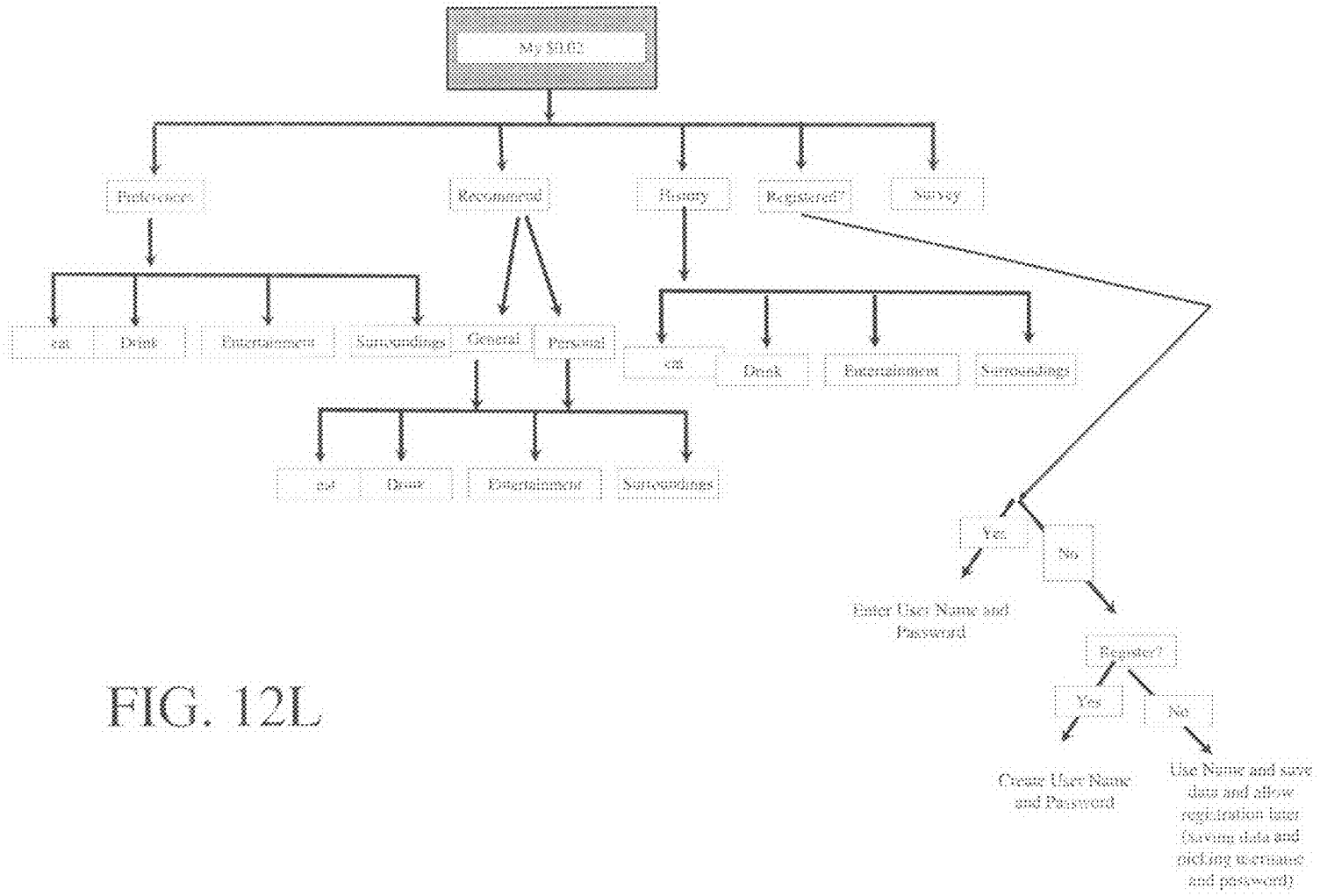
FIG. 12L illustrates a flowchart for a sub-menu of the connect lower level menu.

Once a corresponding category of the connect lower level menu of FIG. 4D has been touched, a sub-menu corresponding to that category may appear, as illustrated in FIGS. 11 to 12L. FIG. 11 illustrates a flowchart for the connect lower level menu. FIGS. 12A to 12I illustrate examples of drink sub-menus to be displayed. FIGS. 12J and 12K illustrate an example of a layout for realizing connection of user devices with the booth 200 FIG. 12L illustrates a flowchart for one of the sub-menus.

Selecting "community" in operation 1110, may bring up a number of local, e.g., within walking distance, options for additional activities, as illustrated in FIG. 12A. Such activities may include movies, retail stores, other restaurants, theaters, museums, and other events. Selecting any one of these activities may display available associated events, as illustrated in FIG. 12B. "Select" may allow a corresponding purchase of that event to be transacted, where appropriate, e.g., movie, theater or museum tickets, may allow a reservation or addition to a wait list to be entered, e.g., in another restaurant, and/or may display a map providing location of that activity. "Info" may display the information as illustrated in FIG. 12C. Such information may include hours, description, which may include location, menus, reviews, and current information. Such current information may include any special offers, daily specials, current wait time, current availability, etc.

As a particular example, selecting movies may provide a selection of movies playing at nearby theaters. Selecting info and then description may play a trailer and selecting hours may show times at each theater. Selecting select may provide options to order or purchase tickets for specific show times.

As another example, selecting restaurants may bring up a list of nearby restaurants. Selecting "info" and then description may display the menu. Selecting "info" and then "current" may indicate availability/current wait time. Selecting "select" may allow for ordering food items for pick up, delivery or for eating in at the nearby restaurant, for making a reservation at the nearby restaurant.

Selecting retail stores may display a list of nearby retail stores. Touching "info" connected with an individual store may display information about the store.

Touching "surroundings" in FIG. 4D may display the menu indicated in FIG. 12D, which may include "lighting", "virtual windows" and "music for virtual windows." Touching "lighting" may allow control of brightness and/or color of ambient lighting in the booth. Touching "virtual windows" may result in display of FIG. 12E, in which an ambient environment may be selected for the booth to be displayed on the wall display, e.g., moon, ocean, Paris, Half Dome, Venice, and so forth. These may be still images or video. Touching "virtual music" may allow music appropriate for the selected "virtual window" to be played, and may default to the general restaurant music if no "virtual window" has been selected.

Touching "entertainment" may produce a display as illustrated in FIG. 12F. Entertainment options for the booth may include, e.g., "television," "music," "social network," "games," and "video." Touching one of these options may display more detailed options. For example, touching "music," may allow provide a display as illustrated in FIG. 12G and may include browse genres, playlists, search collection, satellite radio, purchase new, and so forth.

Selecting "My Devices" may bring up a menu as illustrated in FIG. 12H, e.g., displaying computer, music, photos, video, and so forth. If a user plugs in any devices into the USB port or the SIM card port or firewire port (for example cameras, flash thumb drives, SIM cards or other memory devices) any recognizable files may be immediately copied onto the booth computer 250. Recognizable files may include photos with standard formats (e.g. jpeg or tiff), videos with standard formats (e.g. mpeg, mov), music with standard formats (e.g. wav or mp3). After copying these files, the booth computer 250 may immediately eject the USB storage device, allowing users to unplug their devices soon after they insert them, without causing damage to their devices or interrupting operation of the booth computer 250.

Selecting any of music, video, photos or presentation may bring up a list of the corresponding media files. For example, selecting photos may bring up a list of the photos that have been copied on to the booth hard drive. The list may be displayed in a "flow" mode so that large versions of each photo may be displayed in the front and smaller versions on either side. Two quick touches on a large photo in the center may cause the photo to be displayed on the wall display 232. A single touch and drag may allow other photos to be placed in the center large photo position. Once in the center large photo position, a single touch may display on the wall display 232. Alternatively, photos dragged off of the table display 212 in the direction of the wall display 232 could be displayed on the wall display 232. Additionally, a print option may be provided for the photos. This printing may be occur remotely, so that the restaurant may control and charge for the printing.

Users may connect their own devices to the wall display 232 and/or the booth computer 250. This may be done through a docking station, cables, and so forth, or the user may select "my devices" and then select the particular device to be connected from the "my devices" menu, as illustrated in FIG. 12H. If the device is not connected at this point, then table display 212 may list instructions for connecting a cable to the user's device, as illustrated in FIG. 12I. This cable may be located on the storage portion 260 next to the wall display 232 or in a cabinet 262 in the wall behind a sliding door. For example, when the user's device is a laptop, one of end of this cable may be connected to the wall display 232, while the other end would be available to attach to the user's laptop, as illustrated above in connection with FIGS. 2C and 2D.

For example, if the wall display 232 is an LCD flatscreen TV, the cable may be an RGB video cable. One end of the RGB video cable may be attached before hand to one of the video inputs of the wall display 232, e.g., Video 2 input. Another video input may be attached to the computer, e.g., Video 1 input.

An example of a layout for the interconnection of my devices with the booth 200 is illustrated in FIGS. 12J and 12K. As shown therein, the booth 200 may include the booth computer 250 under one of the seating stations 220, here a bench. An amplifier 270 and an IR transmitter 280 may also under this seating station. The I/O port box 240 may be located in the wall, e.g., under the storage portion 260, and cables extending therefrom may be accessible via the door 262.

As illustrated in FIG. 12K, the wall display 232 may receive outputs form the amplifier 270, the booth computer 250, and the I/O port box 240. The I/O port box 240 may include, e.g., a VGA cable, an Iphone®/Ipod® cable, an audio cable, and so forth, for connecting the user's devices to the booth 200. The I/O port box may also include a USB multi-device box that may be connected to the booth computer 250. The table display 212 may be in communication with the booth computer 250. The amplifier 270 may receive outputs from the booth computer 250 and the I/O port box 240. Additionally, an A/V switch 290 from an external source, e.g., satellite or cable, may further provide outputs, e.g., a video output to the wall display 232 and an audio output to the amplifier 270. The A/V switch 290 may be at a central location and may be used for multiple booths. The IR transmitter 280 may be used by the booth computer 250 to enable a user to send signals to control any inputs for the wall display 232 or the amplifier 270

Once the cable is connected to the user's device, the user may tap a button on the table display 212, e.g., the toggle button in FIG. 12I, to indicate that their device is connected. For example, when the user's device is a laptop, the booth computer 250 may be signaled to change the view on the wall display 232 to the Video 1 input. The IR transmitter 280 may be controlled by the booth computer 250 to act as a remote control and switch the input on the wall display 232 to the video 1 input connected through a cable provided in the booth 200, e.g., a VGA cable shown in FIG. 12K, thereby displaying the contents on the user's laptop on the wall display 232. The toggle button may be tapped again to change the video input to the wall display 232 back to the video output coming from the booth computer 250.

This method allows users to connect laptops to the multimedia booth, without actually connecting their laptop to the booth computer 250. This may reduce security issues associated with direct computer to computer communication. Also, it allows displaying of information on personal laptops of specialized programs that may not be available on the booth computer 250.

Additionally, user's devices other than a laptop, e.g., USB fobs, mp3 players, and so forth, may also be directly connected to the booth computer 250. For some devices, e.g., those that may play readily without delay from the device itself, the files may not be copied onto the booth computer 250.

Selecting "other tables" may allow sending messages to other tables in the restaurant. Further, cameras may be placed at each table 210 to allow sending or viewing images at other tables.

Selecting "my $0.02" may continue to a flowchart as illustrated in FIG. 12H. This display, for example, "preferences," "recommend," "history," "registered," "survey," and so forth. Touching preferences may allow a user to enter personal preferences regarding, for example, "eat", "drink" "entertainment", "surroundings." If the user is not registered, these may only be stored for this dining session. "recommend" may allow either "general" or "personal" recommendations, either of which may then display for example, "eat", "drink" "entertainment", "surroundings." When "general" is selected, most popular items in the respective categories may be listed. When "personal" is selected, items in the respective categories may be listed in accordance with currently entered preferences or stored preferences, if the user is registered. Alternatively or additionally, when "personal" is selected, a user may enter a comparative mode and may enter a favorite item in this or another restaurant and get recommendations for this or another restaurant based on that information. Alternatively or additionally, when "personal" is selected, either an individual mode or a "friends" mode may be selected, allowing recommendations based on input from friends. These "friends" may be automatically associated with a registered user whenever another registered user dines with them, or may be actively allowed by an individual user.

Thus, such recommendations may include personalized recommendations, i.e., based on the individual's past behavior, social recommendations, i.e., based on the past behavior of similar users, and/or item recommendation, i.e., based on the thing selected.

When "history" is selected, similar categories, for example, "eat", "drink" "entertainment", "surroundings" may be displayed. These categories may display current session history, or, if the user is registered, may display overall history.

When "registered" is selected, a user may touch "yes" or "no." If "yes," the user will be prompted to enter a user name and password. If "no", the user may select whether to register or not. If "no", the user may still enter a user name for use in the current session to personalize the experience. If "yes", the user will be prompted to create a user name and password. Alternatively or additionally, the booth 200 may include a card reader, e.g., magnetic or radio frequency, a 1D or 2D barcode scanner, or an ID camera may be positioned under the table to allow a user's identity to be determined from a source, e.g., a credit card, driver's license, passport, frequent diner card, and so forth. These identification mechanisms may also be used for payments. The use of cards may allow the "registered" option to disappear from the my $0.02 sub-menu.

When "survey" is selected, a number of available surveys may be presented. The user may select for the survey to be anonymous, or, if registered, may link their user information. Such surveys may include this restaurant's food, drink, atmosphere, etc., local restaurants' food, drink, atmosphere, etc., or any of the community or entertainment options available.

Restaurant Wide Connectivity

As illustrated in FIG. 13, each booth computer 250 may be connected to the A/V switch 290 and a restaurant server 1300, which may be centrally located within the restaurant. All audio signals may be supplied from various sources (e.g., the A/V switch 290, user devices via the I/O port box 240, the booth computer 259, and so forth) to amplifiers 270 in each booth 200 on an individual basis. All video signals may be supplied from the various sources to the wall display 232. The server 1300 may also be connected to wait stations/kitchen to forward information entered from each booth to the wait staff. Further, the restaurant server 1300 may insure a minimum amount of money is spent in each booth for a particular duration of use. For example, the first half an hour may be free. Before the end of this half hour, an initial inquiry as to whether the customers are ready to order or not may be made. If not, then an amount of time remaining may appear and count down on either one or both of the displays. After this initial time period is up and no order or indication of readiness to order has occurred, the electronics for that booth may be shut down. The timer may be invisible to the customers until the issue of payment for use of the booth needs to be raised.

Alternative Booth Configurations

The booths may be configured in numerous layouts in addition to that illustrate FIG. 2. Alternative examples are illustrated in FIGS. 14A to 14C.

Figure 14A:
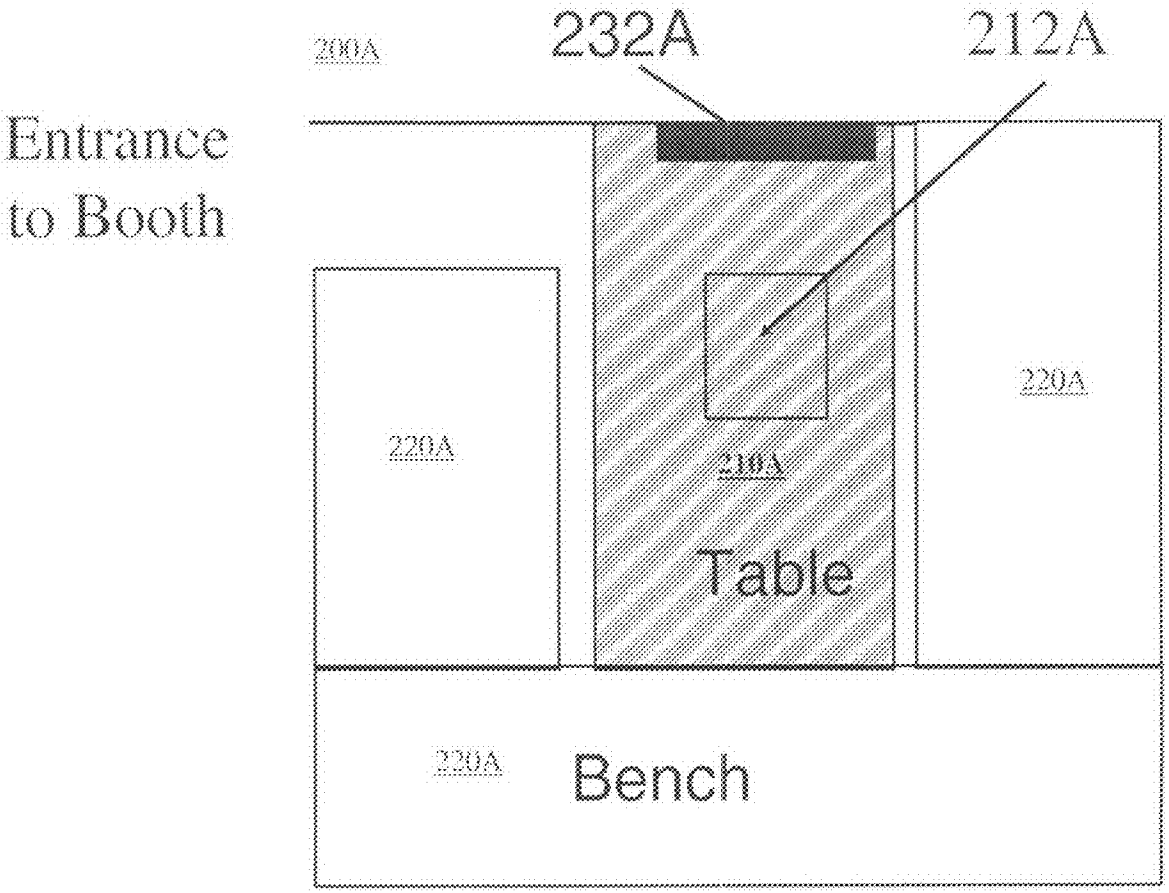
FIGS. 14A-14C illustrate variations on the booth of FIG. 2 in accordance with embodiments.

In an embodiment FIG. 14A, the entrance to a booth 200A is on the side of the booth 200A, providing more privacy for the customers in the booth 200A. Further, as illustrated in FIG. 14A, a touch display 212A may be a separate portable unit that is used at a table 210A, and may be used by any of the users at the restaurant booth. Seating 220A may be on three sides of the table 210A.

Figure 14B:
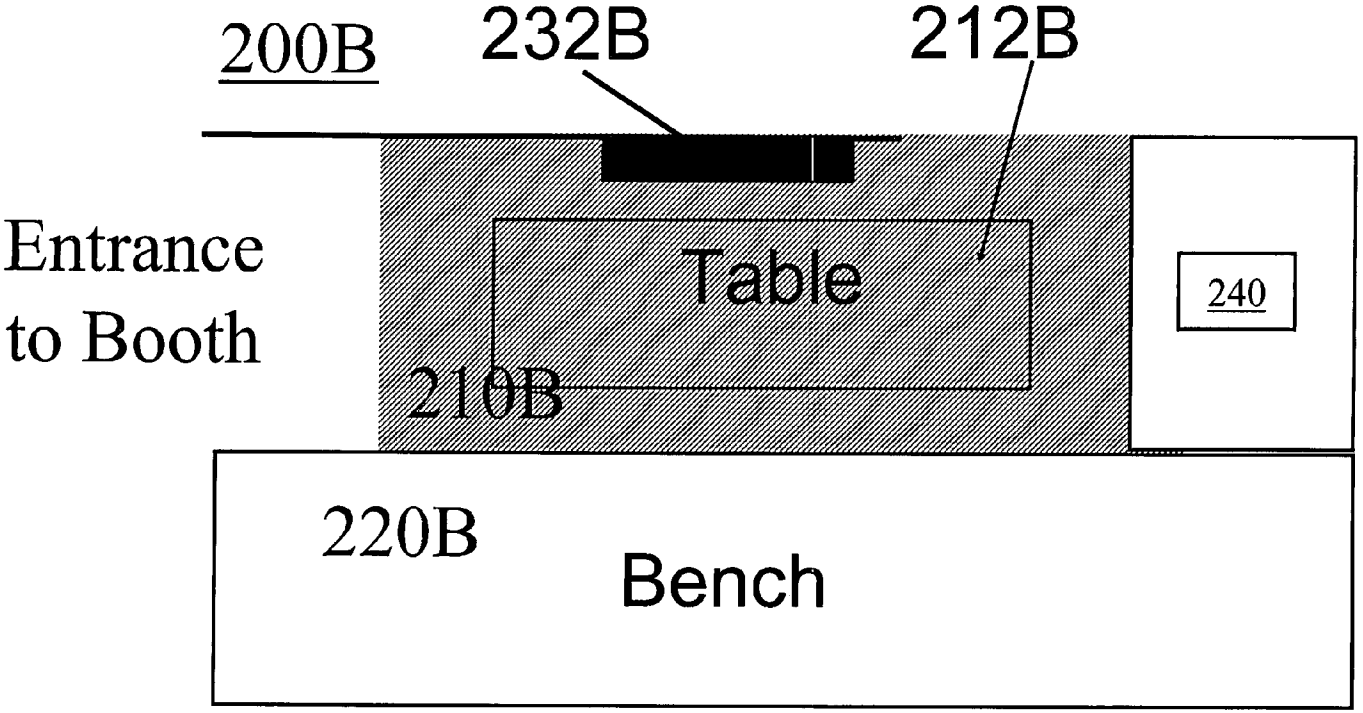
Figure 14C:
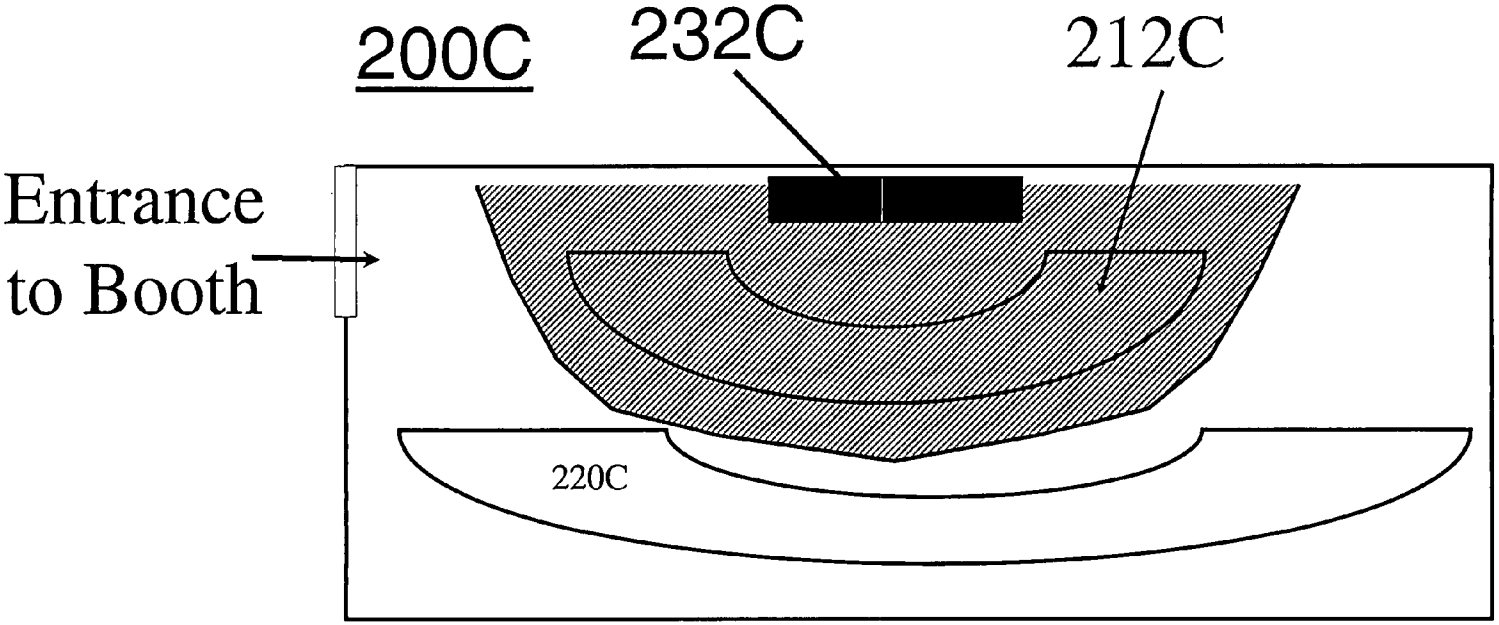

In an embodiment, illustrated in FIG. 14B, a booth 200B may be designed for a smaller number of patrons, e.g., one or two people, and a longer side of a table 210B may be against a wall having the wall display 232B. The seating 220B may be provided on only one side of the table 210B. This configuration may provide all or most of the customers view the wall display 232B directly across from them (without having to turn their head as in FIGS. 2 and 14A).

Alternatively, in any of the embodiments mentioned above, the booth and/or table can be curved to provide better viewing angles. For example, as illustrated in FIG. 14C, a booth 200C may be curved to allow more customers better viewing angles of the wall display 232. In other words, any or all of the booth 200C, seating, 220C, a table 210C and a table display 212C may be curved in such a manner as to allow customers to sit and look at the wall display 232 without having to turn their heads and or bodies as much as in a conventional rectangular shaped restaurant booth.

Single Display Booths

While the above discussion assumes that both the table display 212 and the wall display 232 are present in the booth 200, booths may also be configured having only the table display 212 or the wall display 232.

For example, if only the table display 212 is employed, images that would have been displayed on the wall display may be displayed on at least one sub-screen of the table display. For example, in FIG. 2A, sections of the table display labeled positions 3 to 6 may be used as described above regarding the table display 212. However, positions 1 and 2 may be used to display images (either still or video) similar to that which was displayed on the wall display previously.

For example, a user may attach memory device, e.g., an usb flash drive or an SD card, to a port attached to the booth 200. The photos in this device may then be copied on to the hard drive in the booth computer 250. These photos may then be viewed in positions 3 to 6 in "flow" mode as described above or other modes that allow viewing of multiple photos within a given section. Each photo may be represented as text or as an image that is smaller than the sub-screen. For example, a first user may be viewing multiple small photos in position 3 and a second user may be viewing photos in position 4. Images on the table display 212 that are dragged in to the sub-screens of the table display corresponding to positions 1 and 2 may be displayed in a large format over the entire section. Alternatively, any image moved to position 1 or position 2 may be display in both of these positions, with two different orientations, corresponding to the viewing positions for these two locations. Tapping on a small icon of an image in positions 3 to 6 may result in displaying the image in positions 1 and 2 with the two different orientations. Images may be dragged into a folder. Dragging this folder to position 1 or position 2, or double tapping on this folder, may cause a slide show to be displayed in position 1 and position 2. Changing the functional mode to a single user may cause the slide show to be displayed over the entire table display 212.

Alternatively, if only the wall display 232 is employed, the electronic menus provided on the table screen 212 may now be provided on the wall screen 232. The wall screen 232 may be controlled by a device, e.g., the remote control 285, illustrated in FIG. 12J, rather than the table display 212. This device may also allow sources of the audio/video information to be controlled.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A display, comprising:

a surface having a continuous touch screen display for use by at least two users simultaneously; and a computer in communication with the continuous touch screen display, the computer being configured to reconfigure the continuous touch screen display from an initial configuration into a different configuration, each configuration corresponding to a numerical value, a user being able to input a numerical value in the initial configuration, a numerical value of one corresponding to a single screen and a numerical value of greater than one corresponding to a number of independent sub-screens equal to the numerical value, a user being able to change the numerical value, and, when the numerical value is larger than one, an area of the touch screen display occupied by a sub-screen is determined in accordance with the numerical value such that as the numerical value increases, an area occupied by each individual sub-screen decreases, the computer being configured to allow a user using a first sub-screen to select one of a plurality of media files or run distinct applications within at least one sub-screen of the number of sub-screens through touch inputs within the first sub-screen.

2. The display as claimed in claim 1, wherein the surface is part of a table.

3. The display as claimed in claim 1, wherein at least one sub-screen is configured to display user selected content and another one of the sub-screens controls the at least one sub-screen.

4. The display as claimed in claim 1, wherein the number of sub-screens includes at least one control sub-screen configured to control images displayed in at least one viewing sub-screen of remaining sub-screens.

5. The display as claimed in claim 4, wherein the viewing sub-screen expands to fill more than one sub-screen up to an entirety of the continuous touch screen display.

6. The display as claimed in claim 4, wherein the images displayed are at least one of still images and video images supplied by a user.

7. A multimedia system including the display as claimed in claim 1, further comprising:

a table having the continuous touch screen display; and viewing stations arranged around the table, the table being large enough to accommodate seating at each viewing station.

8. The multimedia system as claimed in claim 7, wherein the viewing stations are seating stations.

9. The multimedia system as claimed in claim 7, wherein each sub-screen being oriented appropriately for each viewing station.

10. The multimedia system as claimed in claim 7, wherein the table is a conventional dining table height and viewing stations are seating stations that allow seats to at least partially fit under the table.

11. The multimedia system as claimed in claim 7, wherein the continuous touch screen display is flush with a top of the table.

12. The display as claimed in claim 7, further comprising:

a common display positioned to be viewable from all viewing stations, the common display configured to display a common image, wherein the continuous touch screen display is configured to control the common display.

13. The multimedia system as claimed in claim 12, further comprising a connector configured to connect a user's device to at least one of the common display and the continuous touch screen display.

14. The multimedia system as claimed in claim 13, wherein the user's device is directly connected only to the continuous touch screen display.

15. The multimedia system as claimed in claim 12, wherein the touch screen display is configured to allow a user to control visual information on the common display, to control audio information adjacent the table, and to view and select from an electronic menu in a venue where the display is located.

16. The multimedia system as claimed in claim 15, wherein items selected from the electronic menu on the continuous touch screen display are displayed on the common display.

17. The multimedia system as claimed in claim 16, wherein the common display visually indicates selected items are ready to be ordered.

18. The display as claimed in claim 1, wherein a touch in a particular location of the continuous touch screen rotates a view of at least one sub-screen.

19. The display as claimed in claim 1, wherein the computer is configured to individually orient each of the sub-screens.

20. The display as claimed in claim 1, wherein the sub-screens together cover a majority of the continuous touch screen.

21. The display as claimed in claim 2, wherein the table provides enough clearance for a seated user to place their knees under the table.

22. The display as claimed in claim 1, further comprising a secondary screen, separate from the continuous touch screen, the computer being in communication with the secondary screen.

23. The display as claimed in claim 22, wherein moving a representation of a particular media file on the continuous touch screen display towards the secondary screen, the computer is configured to send the particular media file to the secondary screen and the secondary screen is configured to display the particular media file.

24. The display as claimed in claim 22, wherein a viewing surface of the secondary screen is at an angle to a viewing surface of the continuous touch screen.

25. The display as claimed in claim 1, wherein the at least one sub-screen is the first sub-screen.

26. The display as claimed in claim 1, wherein the at least one sub-screen is different than the first sub-screen.

27. The display as claimed in claim 1, wherein the user changes the numerical value through a touch input on the continuous touch screen display.

28. A method of providing an interactive multimedia system, the method comprising:

arranging viewing stations around a table having a continuous touch screen display;

positioning a common display to be viewable from all seating stations, the common display configured to display a common image, the continuous touch screen display configured to serve as an input device for the common display;

connecting a computer to the continuous touch screen display for use by at least two users, the computer being configured to reconfigure the continuous touch screen display from an initial configuration into a different configuration, each configuration corresponding to a numerical value, a user being able to input a numerical value in the initial configuration, a numerical value of one corresponding to a single screen and a numerical value of greater than one corresponding to a number of independent sub-screens equal to the numerical value, a user being able to change the numerical value, and, when the numerical value is larger than one, an area of the touch screen display occupied by a sub-screen is determined in accordance with the numerical value such that as the numerical value increases, an area occupied by each individual sub-screen decreases, the computer being configured to allow a user using a first sub-screen to select one of a plurality of media files or run distinct applications within at least one sub-screen of the number of sub-screens through touch inputs within the first sub-screen.

29. The method as claimed in claim 28, wherein connecting the computer includes hard wiring the computer to the continuous touch screen display.

30. The method as claimed in claim 28, wherein the user changes the numerical value through a touch input on the continuous touch screen display.

31. A system, comprising:

multiple multimedia units in at least part of a venue; and a central computer in communication with each multimedia unit, each multimedia unit including a table having a continuous touch screen display for use by at least to users;

viewing stations arranged around the table, and, a computer in communication with the continuous touch screen display, the computer being configured to reconfigure the continuous touch screen display from an initial configuration into a different configuration, each configuration corresponding to a numerical value, a user being able to input a numerical value in the initial configuration, a numerical value of one corresponding to a single screen and a numerical value of greater than one corresponding to a number of independent sub-screens equal to the numerical value, a user being able to change the numerical value, and, when the numerical value is larger than one, an area of the touch screen display occupied by a sub-screen is determined in accordance with the numerical value such that as the numerical value increases, an area occupied by each individual sub-screen decreases, the computer being configured to allow a user using a first sub-screen to select one of a plurality of media files or run distinct applications within at least one sub-screen of the number of sub-screens through touch inputs within the first sub-screen.

32. The system as claimed in claim 31, further comprising:

a common display positioned to be viewable from all viewing stations of at least one multimedia unit, the common display configured to display a common image, wherein the continuous touch screen display is configured to control the common display.

33. The system as claimed in claim 32, wherein the computer is a table computer.

34. The system as claimed in claim 33, wherein the table computer is hard wired to at least one of the common display and continuous touch screen display.

35. The system as claimed in claim 33, further comprising a connector configured to connect a user's device to the table computer.

36. The system as claimed in claim 32, wherein the continuous touch screen display is configured to allow a user to switch at least one of a source of video displayed on the common display and a source of audio.

37. The system as claimed in claim 31, wherein the continuous touch screen display is flush with a top of the table.

38. The system as claimed in claim 32, wherein the continuous touch screen display is configured to allow a user to control visual information on the common display, to control audio information adjacent the table, and to view and select from an electronic menu in a venue where the system is located.

39. The system as claimed in claim 38, wherein items selected from the electronic menu on the continuous touch screen display are displayed on the common display.

40. The system as claimed in claim 38, wherein the items are items that can be ordered and the common display visually indicates selected items are ready to be ordered.

41. The system as claimed in claim 31, wherein the user changes the numerical value through a touch input on the continuous touch screen display.

42. A display, comprising:

a surface having a continuous touch screen display for use by at least two users, the touch screen display having a number of independent sub-screens, at least two sub-screens to be used by each of the at least two users, respectively; and a computer in communication with the continuous touch screen display, the computer being configured to reconfigure the continuous touch screen display from an initial configuration into a different configuration, each configuration corresponding to a numerical value, a user being able to input a numerical value in the initial configuration, a numerical value of one corresponding to a single screen and a numerical value of greater than one corresponding to a number of independent sub-screens equal to the numerical value, a user being able to change the numerical value, and, when the numerical value is larger than one, an area of the touch screen display occupied by a sub-screen is determined in accordance with the numerical value such that as the numerical value increases, an area occupied by each individual sub-screen decreases, the computer being configured to allow a user using a first sub-screen to select one of a plurality of media files or run distinct applications within at least one sub-screen of the number of sub-screens through touch inputs within the first sub-screen.

43. The display as claimed in claim 42, further comprising a secondary screen, separate from the continuous touch screen, the computer being in communication with the secondary screen.

44. The display as claimed in claim 43, wherein moving a representation of a particular media file on the continuous touch screen display towards the secondary screen, the computer is configured to send the particular media file to the secondary screen and the secondary screen is configured to display the particular media file.

45. The display as claimed in claim 43, wherein a viewing surface of the secondary screen is at an angle to a viewing surface of the continuous touch screen.

46. The display as claimed in claim 42, wherein the computer is configured to independently reconfigure an orientation of each sub-screen in accordance with a user input.

47. The display as claimed in claim 42, wherein the user input is a single touch in the at least one sub-screen.

48. The display as claimed in claim 42, wherein the at least one sub-screen is the first sub-screen.

49. The display as claimed in claim 42, wherein the at least one sub-screen is different than the first sub-screen.

* * * * *